US006330776B1

(12) United States Patent
Jinno et al.

(10) Patent No.: US 6,330,776 B1
(45) Date of Patent: Dec. 18, 2001

(54) STRUCTURE FOR REINFORCING CONCRETE MEMBER AND REINFORCING METHOD

(75) Inventors: Yasuo Jinno; Hideto Saito; Hideo Tsukagoshi; Jun'ichi Iketani; Tadao Fujita; Minoru Sawaide; Yasuo Inada; Yoshihiko Shimizu, all of Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/517,509

(22) Filed: Mar. 2, 2000

(30) Foreign Application Priority Data

| | | |
|---|---|---|
| Sep. 16, 1997 | (JP) | 9-251193 |
| Sep. 16, 1997 | (JP) | 9-251194 |
| Sep. 16, 1997 | (JP) | 9-251195 |
| Jan. 6, 1998 | (JP) | 10-001126 |
| May 27, 1998 | (JP) | 10-146403 |
| Jul. 14, 1998 | (JP) | 10-199317 |
| Jul. 22, 1998 | (JP) | 10-206982 |
| Jul. 22, 1998 | (JP) | 10-206983 |
| Jul. 22, 1998 | (JP) | 10-206984 |
| Jul. 22, 1998 | (JP) | 10-206985 |

(51) Int. Cl.[7] ..... E04G 23/02

(52) U.S. Cl. ..... 52/649.1; 52/514; 52/167.1; 52/721.4; 52/698; 52/649.2

(58) Field of Search ..... 52/156, 649.1, 52/649.2, 698, 721.4, 721.5, 167.1, 514, 514.5, 327, 223.8, 417, 600

(56) References Cited

U.S. PATENT DOCUMENTS

| | | | | |
|---|---|---|---|---|
| 5,649,398 | | 7/1997 | Isley et al. . | |
| 5,657,595 | * | 8/1997 | Fyfe et al. | 52/252 |
| 5,924,262 | * | 7/1999 | Fawley | 52/721.4 |
| 5,937,606 | | 8/1999 | Meier et al. . | |
| 5,960,597 | * | 10/1999 | Schwager | 52/223.4 |
| 6,189,286 | * | 2/2001 | Seible et al. | 52/721.4 |

FOREIGN PATENT DOCUMENTS

| | | |
|---|---|---|
| 197 02 246 | 7/1998 | (DE) . |
| 197 33 065 | 7/1998 | (DE) . |
| 2 754 556 | 4/1998 | (FR) . |
| WO 96 21785 | 7/1996 | (WO) . |

* cited by examiner

*Primary Examiner*—Carl D. Friedman
*Assistant Examiner*—Dennis L. Dorsey
(74) *Attorney, Agent, or Firm*—Nixon & Vanderhye PC

(57) ABSTRACT

In the structure for reinforcing a concrete member and the reinforcing method of the present invention, a reinforcing sheet is arranged and joined to a various kinds of concrete member, such as column, beam, wall, floor, and the like, by applying the reinforcing sheet to the surface of the concrete member and attaching to the fixing anchors joined to the concrete member or the other concrete member surrounding the concrete member. The fixing anchor comprises a large amount of reinforcing fiber, and is obtained by bundling a part of the reinforcing fiber. The unbundled portion of the fixing anchor is spread along the surface of the concrete member. The reinforcing sheet is over-lapped to the unbundled portion using resin adhesives. In addition, reinforcing fibers, such as carbon fiber, aramid fiber, glass fiber, and the like are preferably used as the material comprising the fixing anchor and reinforcing sheet. Thereby, the reinforcing member can be joined via the fixing anchor to the concrete members. Therefore, it is possible to securely join the edges of the reinforcing member, and reliably exert the reinforcing effects on the concrete member.

32 Claims, 22 Drawing Sheets

(a)

(b)

(a)

(b)

(a)

(b)

STRUCTURE FOR REINFORCING CONCRETE MEMBER AND REINFORCING METHOD

This application is a Continuation of PCT/JP98/04149 filed Sep. 16, 1998, the entire content of which is hereby incorporated by reference in this application.

TECHNICAL FIELD

The present invention relates to a structure for reinforcing a concrete member and a reinforcing method which are suitable for reinforcing various concrete members.

BACKGROUND ART

As one conventional method for reinforcing a concrete member having a reinforced concrete structure or a steel framed reinforced concrete structure, such as a column, beam, bent, and stack, there is a method in which a reinforcing sheet made of reinforcing fibers, such as carbon fibers, aramid fibers, glass fibers, or the like is arranged and attached on the surface of the concrete member. In this method, in order to reinforce the concrete member against bending stress applied thereto, the reinforcing sheet is arranged and attached along the concrete member. In order to reinforce the concrete member against shearing stress applied thereto, the reinforcing sheet is arranged and attached so as to wrap around the concrete member.

In order to stably fix the reinforcing sheet onto the surface of the concrete member, an adhesive is often used. However, when the reinforcing sheet is merely attached to the concrete member using an adhesive and the reinforcing sheet (in particular, the edges thereof) peels from the surface of the concrete member due to any reasons, the reinforcing sheet cannot sufficiently exert its reinforcing effects. Therefore, the edges of the reinforcing sheet are reliably joined to the concrete member by joining the edges of the reinforcing sheet using an anchor hammered and joined into the concrete member and a steel plate.

However, the structure for reinforcing a concrete member and the reinforcing method using the reinforcing sheet have the following problems. Hammering the anchor for joining the edges of the reinforcing sheet using an anchor and steel plate requires a great deal of time. In addition, the anchor made of steel has a large diameter. Therefore, when the reinforcing sheet is joined in existing building, there are problems such as noise and vibration occur due to the anchor hammering under constructions. Moreover, the head portions of the anchors or the fitting members for the steel plates protrude from the surface of the concrete member. Therefore, when facings such as facing panel are joined, it is necessary to make and keep a clearance between the surface of the concrete member and the top portion of the anchor or the fitting members using brackets or the like, in order to avoid the top portion of the anchor or fitting members. The execution of this work requires a great deal of time.

Moreover, when the planar concrete members, such as a wall, floor, and the like are desired to be reinforced with the reinforcing sheet, it is impossible to wrap the concrete members similar to columns and beams. When the columns or the beams are integrated with the wall or the slab, the reinforcing sheet also cannot be wraped around the columns or the beams. In these cases, the edges of the reinforcing sheet should be more reliably joined. Therefore, in these cases, the problems are significant.

In order to solve the problems, a method in which the slits 3 are formed in the wall (beam, floor, or the like) 2 joined with the column (or beam) 1, and the reinforcing sheet 4 is wrapped around the column 1 by passing the reinforcing sheet 4 through the slits 3, can be expected. Then, the slits 3 are filled with a resin 8, a mortar, or the like after passing the reinforcing sheet 4 through the slits 3.

In the structure obtained by this method, the slits 3 are filled with resin or mortar; however, the reinforcing sheet 4 made of a combustible material is uncovered at both surfaces of the wall 2. Therefore, the fire protecting performance of this structure must be improved by covering the bare reinforcing sheet 4 at at least one surface of the wall 2 with a covering portion 9 formed by coating with a non-combustible material such as mortar, and the like.

However, the coating of the non-combustible material for forming the covering portion 9 requires a great deal of time and great expense. In addition, the covering portion 9 protrudes from the surface of the wall 2. Therefore, when facings such as facing panel are joined, it is necessary to make and maintain a clearance between the wall and the covering portion 9 using brackets or the like. The problem that the finished size of the structure increases arises.

There is a reinforcing method in which a wall of existing building is reinforced, and whereby the proof stress of existing building is increased, as a method for improving the earthquake resistance of existing building having a reinforced concrete structure. Specifically, concrete is coated on the surface of the wall, a steel plate is attached to the surface of the wall, or a reinforcing unit comprising a brace made of steel is arranged between the beam and the column positioned at the edges of the wall.

However, these reinforcing methods have the problems that they must be executed on a large scale, and long construction periods and great expense cost, are required. In addition, in the reinforcing method in which the steel plate and the reinforcing unit are used, these materials are heavy; therefore, these materials impose burdens on workers. Moreover, a jack is necessary and the problem of increasing the cost for equipment arises. Furthermore, welding at the construction site is necessary. The welding is accompanied by noise; therefore, the construction cannot be executed while the building in use.

In addition, the reinforced wall becomes thicker compared with the wall before the reinforcement; therefore, the room space becomes smaller. The materials used for reinforcing are heavy; therefore, it is necessary to consider problems due to the weight increase while the building is being reinforced. Consequently, these reinforcing methods have problems such as being inefficient.

DISCLOSURE OF INVENTION

A structure for reinforcing a concrete member according to claim 1 is the structure for reinforcing the concrete member characterized in that a fixing anchor which comprises a plurality of reinforcing fibers such as carbon fibers, aramid fibers, glass fibers, and the like, and a part of which is bundled in the longitudinal direction, is arranged and joined so that at least the bundled portion is joined to the concrete member or the other concrete member surrounding the concrete member, and the unbundled portion is spread along the surface of the concrete member; and a reinforcing member in the form of a plate or sheet is joined to the concrete member, via the fixing anchor by arranging and attaching to the concrete member, and superposing and joining at least the edges of the reinforcing member to the unbundled portion of the fixing anchor.

According to the structure for reinforcing a concrete member, the edges of the reinforcing member are securely joined to the concrete member by joining the reinforcing member to the concrete member, via the fixing anchor. The peeling of the edges of the reinforcing member can be prevented. It is possible to exert reliably reinforcing effects in the concrete member. Moreover, under a reinforcing construction, forming recesses for attaching the bundled portion of the fixing anchors is only source of the noise and vibration. And the holes have a smaller diameter than the diameter of the conventional anchors made of steel. It is possible to minimize the noise and the vibration. Therefore, it remains possible to easily adopt the structure for reinforcing a concrete member to existing buildings. There is no protrusion at the surface of the reinforcing member. Fixing the facings does not require a great deal of time.

A structure for reinforcing a concrete member according to claim 2 is the structure for reinforcing a concrete member according to claim 1, characterized in that said reinforcing member is in the form of a sheet and comprises reinforcing fibers such as carbon fibers, aramid fibers, glass fibers, and the like. The reinforcing member has sufficient strength, and nevertheless it is light. Handling the reinforcing member is easy under a reinforcing construction. Easy handling decreases the labor imposed on the workers. Moreover, heavy machineries like cranes are not necessary; therefore, the construction can be smoothly performed even inside of existing building and the like.

A structure for reinforcing a concrete member according to claim 3 is the structure for reinforcing a concrete member according to claim 1 or 2, characterized in that said fixing anchor is arranged inside the recess formed in the concrete member and the recess is filled with a hardening filler. When the fixing anchor is arranged inside the recess formed in the concrete member, and the recess is filled with a hardening filler, the fixing anchor is not exposed and does not protrude from the surface of the concrete member. When facings are arranged on the surface of the concrete member, the finished size of the concrete member does not become larger. The arranging of the facing does not require much time. Moreover, the recess is filled with the hardening filler; and therefore, the fixing anchor is not exposed outside. Even when the fixing anchor is made of combustible materials, the fire protecting performance can be improved.

A structure for reinforcing a concrete member according to claim 4 is the structure for reinforcing a concrete member according to one of claims 1 to 3, characterized in that a fixing reinforcing member is superposed and attached to the reinforcing member so as to be located perpendicularly to the continuous direction of the reinforcing member where the reinforcing member and the end portion of the fixing anchor are superposed. Thereby, the fixing strength at where the reinforcing member and the fixing anchor are superposed, is further improved. Therefore, it is possible to join securely the reinforcing member to the concrete member.

A structure for reinforcing a concrete member according to claim 5 is the structure for reinforcing a concrete member according to one of claims 1 to 4, characterized in that said reinforcing member is arranged and joined along longitudinal direction. Thereby, it is possible to reinforce the concrete members such as a column and beam against bending stress applied thereto.

A structure for reinforcing a concrete member according to claim 6 is the structure for reinforcing a concrete member according to one of claims 1 to 4, characterized in that said reinforcing member is arranged and joined along the circumferential direction of the concrete member. Thereby, it is possible to reinforce the concrete members such as a column and beam against shearing stress applied thereto.

A structure for reinforcing a concrete member according to claim 7 is the structure for reinforcing a concrete member according to one of Claims 1 to 4, characterized in that said reinforcing member is arranged and joined along the concrete member in the form of a plane or curved surface. Thereby, it is possible to improve the ductility and proof stress of the concrete member in the form of a plane or curved surface against bending stress or shearing stress applied thereto. For example, it is also possible to prevent the occurrence of cracks at the curved surface of a concrete member such as a tunnel linings. In addition, even when the reinforcing member is arranged and joined on only one surface of the concrete member, sufficient reinforcing effects can be obtained. Therefore, it is possible to exert its reinforcing effects in members which have been difficult to reinforce, such as an elevator shaft, exterior wall, staircase, and the like.

A structure for reinforcing a concrete member according to claim 8 is the structure for reinforcing a concrete member according to one of claims 1 to 4, characterized in that said reinforcing member comprises reinforcing fibers aligned in a given direction, and is joined to the surface of the concrete member so that the reinforcing fibers are aligned at an angle to the concrete member. When the reinforcing fibers comprising the reinforcing sheet are aligned at some given angle to the concrete member, the reinforcing sheet exerts functions similar to the functions of a brace. Ductility and proof stress against bending stress or shearing stress applied to the concrete member in the form of a plane or curved surface, such as a floor, wall, and the like, can be improved. Therefore, the earthquake resistance of buildings can be improved. In addition, even when the reinforcing sheet is arranged and joined on only one surface of the concrete member, sufficient effects can be obtained. Therefore, it is possible to reinforce in the members which have been difficult to reinforce, such as an elevator shaft, exterior wall, staircase, and the like.

A reinforcing method of a concrete member according to claim 9 comprising the steps of: joining a fixing anchor comprising a plurality of reinforcing fibers, such as carbon fibers, aramid fibers, glass fibers, and the like in a hole or recess formed in the concrete member or the other concrete member surrounding the concrete member, while arranging and attaching a reinforcing member in the form of a plate or a sheet on the surface of the concrete member, and superposing and joining the edges of the reinforcing member to the end portion of the fixing anchor. According to the reinforcing method, it is possible to join the reinforcing member, via the fixing anchor to the surrounding concrete members. The reinforcing method can provide the structure for reinforcing a concrete member according to claim 1. In addition, it is also possible to prevent the peeling of the edges of the reinforcing member, and to exert reliably reinforcing effects in the concrete member. During the hole for the fixing anchor is the only source of the noise and the vibration, and also the holes are smaller than those of the conventional steel anchors, we can minimize the construction noise and vibration. Therefore, the reinforcing method can be easily adopted easily to existing buildings. There remains no protrusion at the surface of the reinforced member. Fixing the facings does not require significant time.

A reinforcing method according to claim 10 is the reinforcing method according to claim 9, characterized in that a part of the fixing anchor is embedded in a recess by forming the recess at the surface of the concrete member, arranging the part of the fixing anchor in the recess, and filling the recess with a hardening filler. The reinforcing method can provide the structure for reinforcing a concrete member according to claim 3. The finished size of the concrete member does not increase. This reinforcing method does not require significant time. Even when the fixing anchor is made of combustible materials, the fire protecting performance can be improved, because the fixing anchor does not expose outside.

A reinforcing method according to claim 11 is the reinforcing method according to claim 9 or 10, characterized in that a part of bundles of reinforcing fibers in the longitudinal direction is bundled and joined as said fixing anchor by inserting a part of bundles of reinforcing fibers into the hole or recess, and filling the hole or recess with a hardening filler. According to the reinforcing method according to claim 11, it is not necessary to previously make the fixing anchor comprising bundles of reinforcing fibers; therefore, a lower cost can be achieved. In addition, the number or length of the reinforcing fibers can also be easily changed in construction site; therefore, the reinforcing construction can be easily performed.

MODES FOR CARRYING OUT THE INVENTION

Hereinbelow, examples of the present invention will be explained with reference to Figures.

FIRST EXAMPLE

Shearing Reinforcement of a Column and Beam

Hereinbelow, the structure for reinforcing a concrete member and the reinforcing method of the present invention will be explained with reference to the examples in which the structure and the reinforcing method are adopted to columns and beams.

Figure 1:
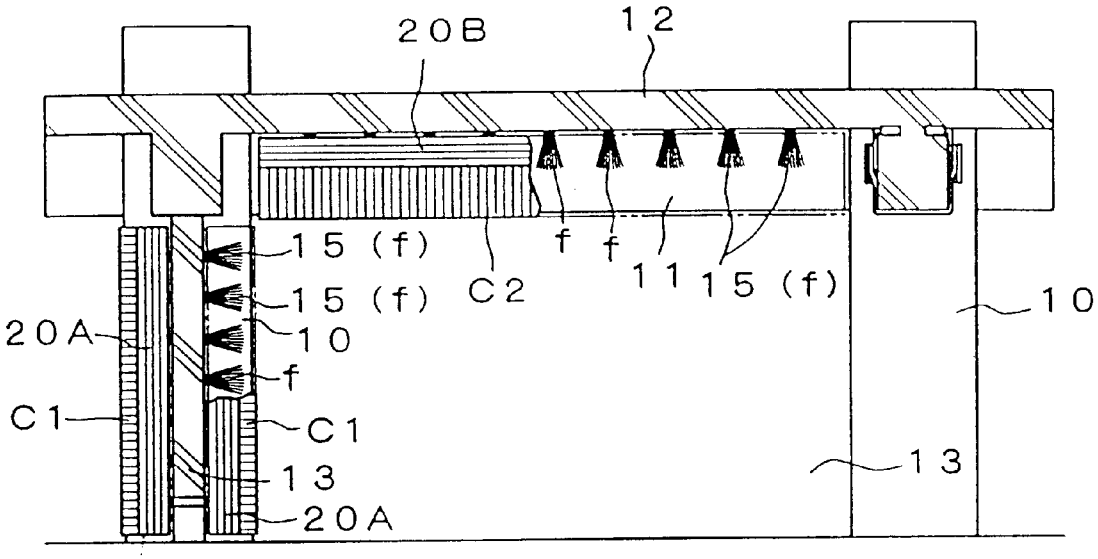
FIG. 1 shows the first example of the structure for reinforcing a concrete member and the reinforcing method according to the present invention, and is a longitudinal sectional view showing a reinforced column and beam using the reinforcing sheet.

FIG. 1 shows a part of the structure having a reinforced concrete structure or a steel framed reinforced concrete structure. In this figure, reference numeral 10 denotes a column (being a concrete member), reference numeral 11 denotes a beam (being a concrete member), reference numeral 12 denotes a floor formed on the beam 11, and reference numeral 13 denotes a wall.

As shown in FIG. 1, the column 10 is integrally joined to the wall 13. On the top surface of the beam 11, the floor 12 is integrally formed.

In order to reinforce the column 10 and the beam 11 against shearing stress, reinforcing sheets C1 and C2 are arranged and joined to the column 10 and the beam 11. These reinforcing sheets (reinforcing members) C1 and C2 comprise reinforcing fibers such as carbon fibers, aramid fibers, glass fibers, and the like. In order to obtain the reinforcing effects in the circumferential direction of the column 10 and the beam 11, the fiber alignment direction (corresponding to the weaving direction when the reinforcing fibers are in the form of a cloth) is set.

Figure 2:
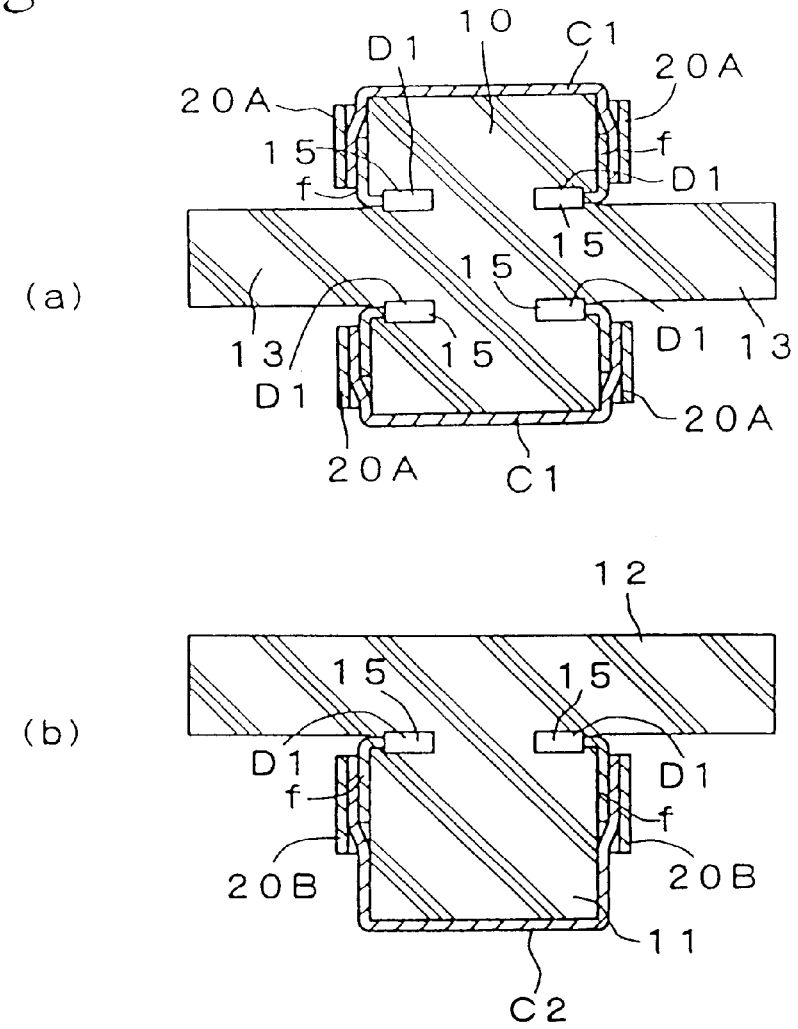
FIG. 2 is a plane cross-sectional view and a longitudinal sectional view showing the column and beam which are joined to the reinforcing sheet.

As shown in FIG. 2(*a*), the reinforcing sheet C1 is arranged and joined to the one side and the other side of the walls 13 and 13 integrally joined with the column 10. Moreover, the reinforcing sheet C1 is arranged and attached so as to wrap the three sides of the column 10, and both edges thereof are joined using the fixing anchors D1 at the corner of the column 10 and the wall 13.

In addition, as shown in FIG. 2(*b*), the reinforcing sheet C2 is arranged and attached to the beam 11 so as to wrap both sides and the under side of the beam 11. Both edges of the reinforcing sheet C2 are joined using the fixing anchors D1 at the corner of the beam 11 and the floor 12.

Figure 3:
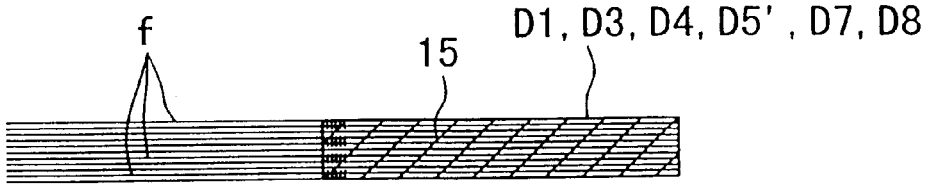
FIG. 3 is an outside view showing the fixing anchor used for joining the reinforcing sheet.

As shown in FIG. 3, the fixing anchor D1 comprises a large number of reinforcing fibers f, such as carbon fibers, aramid fibers, glass fibers, and the like, and is obtained, for example, by bundling the reinforcing fibers at a bundled portion 15 on the proximal end part side using an adhesive or resin, for example. The reinforcing fibers f are not bundled on the distal end part side. As shown in FIGS. 2(*a*) and 2(*b*), the fixing anchor D1 is joined to the column 10 and the beam 11 by inserting the bundled portion 15 into a hole (not shown in these figures) formed in the column 10 and the beam 11 and filling the hole (not shown in these figures) with a hardening filler.

As shown in FIG. 1, the reinforcing fibers f in the distal end part, which are joined in the above manner, are spread along the surface of the column 10 and beam 11. The reinforcing sheets C1 and C2 cover the reinforcing fibers f at the distal end part. Then, the fixing anchors D1 and the reinforcing sheets C1 and C2 are attached with an adhesive.

Moreover, fixing reinforcing members 20A and 20B are further superposed and attached on the reinforcing sheets C1 and C2 at the portion where the reinforcing fibers f at the distal end part of the fixing anchor D1 and the reinforcing sheet C1 and C2 are superposed. These fixing reinforcing members 20A and 20B are made of material similar to the reinforcing sheet C1 and C2, and have a directionality by which the reinforcing effects against the direction perpendicular to the reinforcing direction of the reinforcing sheet C1 and C2 can be obtained.

Both edges of the reinforcing sheets C1 and C2 that are continuous around the column 10 and the beam 11 are joined at the column 10, the beam 11, or the vicinity of the column 10 or the beam 11, via the fixing anchor D1. Moreover, both edges of the reinforcing sheets C1 and C2 are reinforced by fixing reinforcing members 20A and 20B.

As explained above, the reinforcing sheets C1 and C2 having reinforcing effects in the circumferential direction of the column 10 and the beam 11 is joined to the column 10 and the beam 11 by attaching both edges of the reinforcing sheets C1 and C2 to the fixing anchor D1 attached to the column 10 and the beam 11. Furthermore, the fixing reinforcing members 20A and 20B are superposed and attached to the reinforcing sheets C1 and C2. That is, both edges of the reinforcing sheets C1 and C2 are securely joined to the column 10 and the beam 11 by joining the reinforcing sheet C1 and C2 with the fixing anchor D1. The peeling of the edges of reinforcing sheets C1 and C2 can be prevented. Therefore, it is possible to exert reliably reinforcing effects in the column 10 and the beam 11 against shearing stress applied thereto.

In addition, during the execution, drilling the hold is the only source of the noise and the vibration, and the diameter of the hole is smaller than the diameter of the ordinary steel anchoring. It is possible to minimize the noise and the vibration. Therefore, it is possible to adopt easily the structure for reinforcing the concrete member and the reinforcing method to existing buildings. In addition, there remains no protrusion at the surface of the reinforcing sheet C1. When facings are arranged and joined onto the reinforcing sheet C1, fixing the facings does not require significant time.

Furthermore, the reinforcing sheet C1 and C2 is made of reinforcing fibers, and has sufficient strength, and nevertheless it is light. Handling the reinforcing sheet C1 and C2 is easy. Easy handling decreases the labor imposed on the workers. Moreover, heavy machineries like cranes are not necessary; therefore, the construction can be smoothly performed even inside of existing building and the like.

Figure 4:
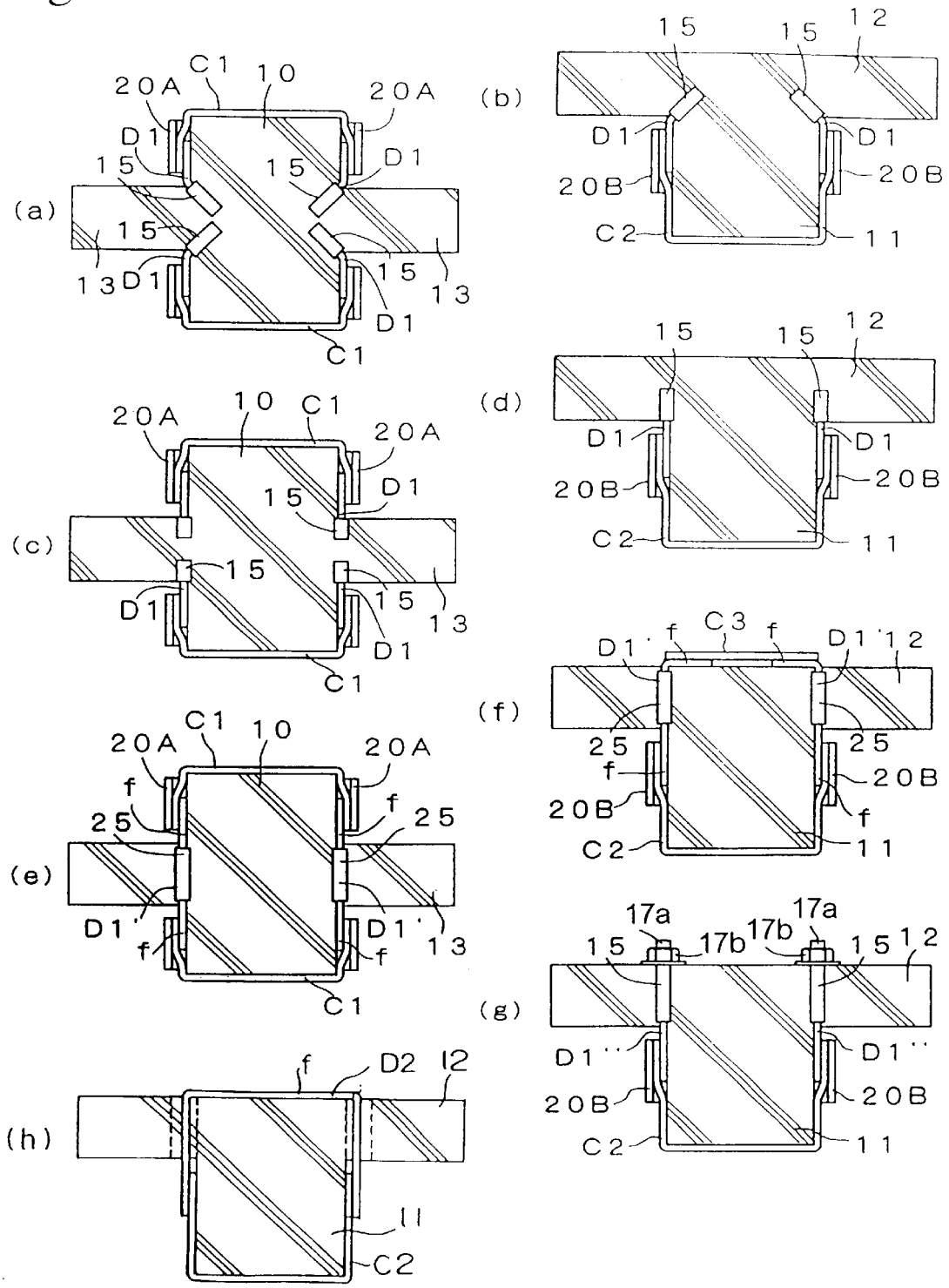
FIG. 4 is a plane cross-sectional view and a longitudinal sectional view showing the other examples of the joining structure in which the fixing anchor is joined to the column and the beam.

Moreover, in this example, the structure in which the bundled portion 15 of the fixing anchor D1 is joined perpendicularly to the column 10 and the beam 11 was explained. However, the angle between the bundled portion 15 of the fixing anchor D1 and the column 10 and the beam 11 is not limited. It is possible to adopt suitable angles other than perpendicular angle. For example, as shown in FIGS. 4(*a*) and 4(*b*), the bundled portion 15 may be joined so as to be obliquely disposed on the column 10 and the beam 11. Moreover, as shown in FIGS. 4(*c*) and 4(*d*), the bundled portion 15 may be joined to the floor 12 fixed to the beam 11 or the wall 13 fixed to the column 10.

Figure 5:
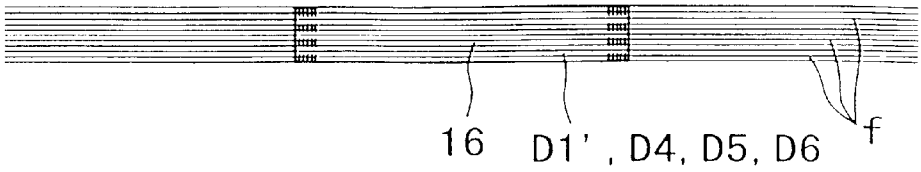
FIG. 5 is an outside view showing the other example of the fixing anchor.

In addition, as shown in FIG. 4(*e*), the reinforcing sheets C1 and C1 at both sides of the column 10 may be attached each other using the fixing anchors D1'. As shown in FIG. 4(*f*), the reinforcing sheet C2 at the under surface of the beam 11 and the reinforcing sheet C3 at the upper surface of the beam 11 may be attached to each other using the fixing anchors D1. As shown in FIG. 5, the using fixing anchor $D^{1'}$ is made of a large amount of reinforcing fiber f. The using fixing anchor D1 comprises a bundled portion 16 having a given length at the intermediate portion in the longitudinal direction, which is formed by bundling the reinforcing fibers f using an adhesive, resin, or the like. From the both ends to the bundled portion 16 are free of bundles. As shown in FIGS. 4(*e*) and 4(*f*), the used fixing anchor D1' is joined to the wall 13 or the floor 12 by inserting the bundled portion 16 into the hole (not shown in Figures) formed in the wall 13 or the floor 12, and filling the hole (not shown in Figures) with an adhesive and the like. Then, the reinforcing fiber f at both sides of the bundled portion 16 of the fixing anchor D1' are spread along the side surfaces of the column 10 and the beam 11 and the upper surface of the floor 12. The reinforcing sheets C1, C1, C2, and C3 are applied onto the reinforcing fibers f, and attached each other using an adhesive and the like.

As shown in FIG. 4(*g*), the fixing anchor D1" may be joined using a bolt and the like. In this case, the fixing anchor D1 " comprising a screw portion 17*a*, formed at the end of the bundled portion 15, is used. The fixing anchor D1" is securely joined by extruding the screw portion 17*a* from the upper surface of the floor 12, and driving nut 17*b* in the screw portion 17*a*.

As shown in FIG. 4(*h*), the fixing anchor D2 comprising bundled reinforcing fibers f may be arranged and attached so as to shape an inverse U shape. Then, the circumference of the beam 11 may be wrapped with the fixing anchor D2 and the reinforcing sheet C2. The fixing anchor D2 and the reinforcing sheet C2 are attached each other using an adhesive and the like.

Figure 6:
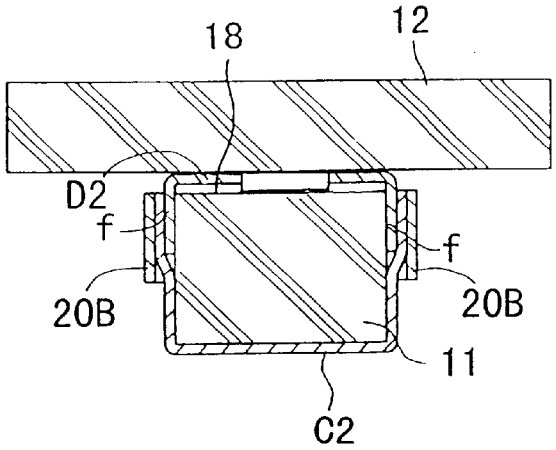
FIG. 6 is a sectional view showing the other examples f the joining structure in which the fixing anchor is joined to the column and the beam.
Figure 6:
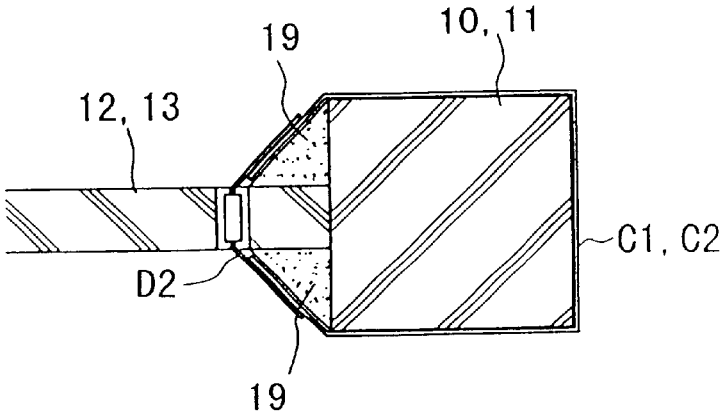

As shown in FIG. 6(*a*), the structure in which a penetrating hole 18 extending one side, upper surface, and the other side of the beam 11 is formed, and the fixing anchor D2 is joined through the penetrate hole 18, can be adopted.

Furthermore, as shown in FIG. 6(*b*), the structure in which an inclined surface 19 is formed by piling mortar and the like at the comer of the column 10 or the beam 11 and the wall 13 or the floor 12 which are joined to the column 10 or the beam 11, the reinforcing sheet C1 and C2 are wrapped around the column 10 or the beam 11, and the reinforcing sheet C1 and C2 are joined using the fixing anchor D2 can be adopted. In this structure, it is possible to prevent the sharp bending of the reinforcing sheet C1 and C2 at the corner portions. Therefore, it is also possible to prevent the concentration of stress on the reinforcing sheets C1 and C2 at the corner of the column 10 or the beam 11. Moreover, the corner of the column 10, the beam 11, or the like may be chamfered.

SECOND EXAMPLE

Bending Reinforcement of a Beam

Figure 7:
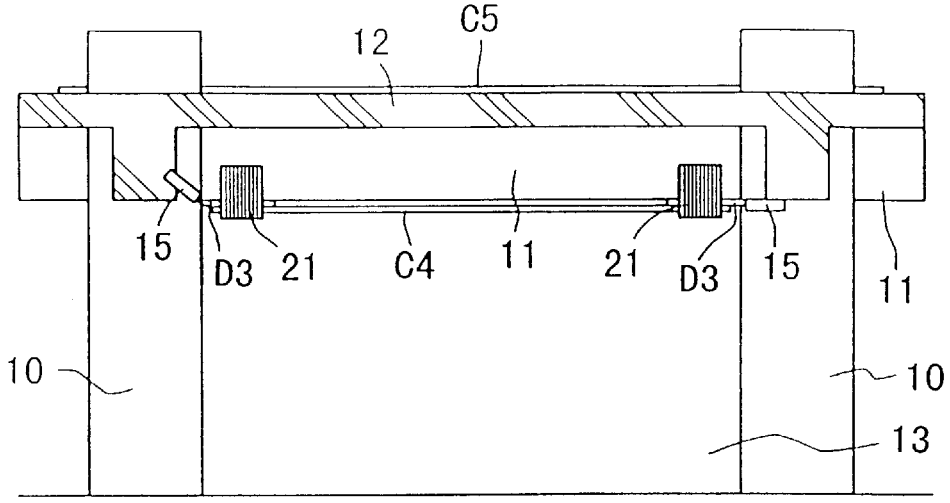
FIG. 7 shows the second example of the structure for reinforcing a concrete member and the reinforcing method according to the present invention, and is a longitudinal sectional view showing a reinforced beam using the reinforcing sheet.

As shown in FIG. 7, in order to reinforce the beam 11 against bending stress applied thereto, the reinforcing sheet (reinforcing member) C4 is attached to the under surface of the beam 11. The reinforcing sheet C4 comprises reinforcing fibers, such as carbon fibers, aramid fibers, glass fibers, and the like. The fiber direction (corresponding to the weaving direction when the reinforcing fibers are in the form of a cloth) of the reinforcing sheet C4 is set to the beam direction so that reinforcing effects in the longitudinal direction.

Both edges of the reinforcing sheet C4 are joined by the fixing anchors D3. As shown in FIG. 3, the fixing anchor D3 comprises a large amount of reinforcing fibers f, such as carbon fiber, aramid fiber, glass fiber, and the like, and is obtained by bundling the reinforcing fibers at a bundled portion 15 on the proximal end part side using an adhesive or resin, for example. The reinforcing fiber f are not bundled on the distal end part side. As shown in FIG. 7, the fixing anchors D3 are joined to the columns 10 by inserting the bundled portion 15 into the holes (not shown in figure) formed in the columns 10 and 10 which are located at both ends of the beam 11, and filling the holes with an adhesive and the like. The bundled portion 15 of the fixing anchor D3 may be obliquely joined to the column 10, as shown on the left side of FIG. 7. Moreover, the bundled portion 15 of the fixing anchor D3 may be perpendicularly joined to the column 10, as shown on the right side of FIG. 7. Furthermore, the bundled portion 11 may be joined to the under surface or the side surfaces of the beam 11 at the ends of the beam 11.

The reinforcing fibers f in the distal end part of the fixing anchors D3 joined in the above manner, are spread along the under surface of the beam 11. The reinforcing sheet C4 covers the reinforcing fibers f. Then, these fixing anchors D3 and the reinforcing sheet C4 are over-lapped with an adhesive.

Moreover, fixing reinforcing members 21 are further superposed and attached at the portions where the reinforcing fiber f at the distal end part of the fixing anchor D3 and the reinforcing sheet C4 are superposed. This fixing reinforcing member 21 is made of material similar to the reinforcing sheet C4, and is applied perpendicular to the reinforcing direction of the reinforcing sheet C4. Reinforcing member 21 is applied U shaped from side to side.

Moreover, in order to further reinforce the beam 11, the reinforcing sheet C5 is attached to the floor 12 at the position corresponding to the upper surface of the beam 11.

Both edges of the reinforcing sheet C4 are joined to the beam 11, via the fixing anchors D3. Furthermore, the joint between both edges of the reinforcing sheet C4 and the beam 11 is reinforced by the fixing reinforcing members 21.

As explained above, the reinforcing sheet C4 extending along the axis direction of the beam 11 is arranged approximately over the entire length of the under surface of the beam 11. Both edges of the reinforcing sheet C4 are joined, via the fixing anchors D3 comprising a large amount of reinforcing fiber f. Furthermore, the fixing reinforcing members 21 are superposed and attached to both edges of the reinforcing sheet C4. Thereby, it is possible to securely join the reinforcing sheet C4, in particular, both edges of the reinforcing sheet C4. The peeling of the edges of the reinforcing sheet C4 can be prevented. Therefore, it is also possible to exert reliably reinforcing effects in the beam 11 against bending stress applied thereto.

In addition, during the execution, the only source of the noise and the vibration is the drilling the hole, and also the diameter of the hole is smaller than the diameter of the ordinary anchors, it is possible to minimize the construction noise and the vibration. Therefore, it is possible to adopt easily the structure for reinforcing a beam and the reinforcing method to existing buildings. In addition, there remains no protrusion at the surface of the reinforcing sheet C4. When facings are arranged and joined onto the reinforcing sheet C4, fixing the facings does not require significant time.

THIRD EXAMPLE

Bending Reinforcement of a Column

Figure 8:
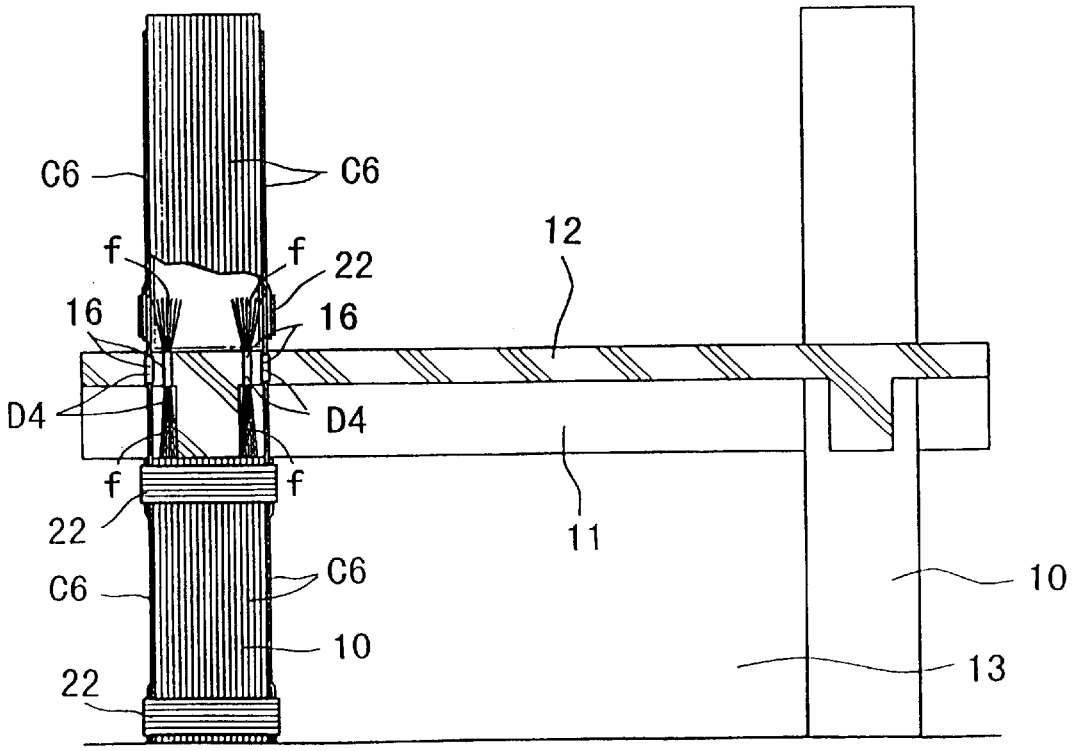
FIG. 8 shows the third example of the structure for reinforcing a concrete member and the reinforcing method according to the present invention, and is a longitudinal sectional view showing a reinforced column using the reinforcing sheet.

As shown in FIG. 8, in order to reinforce the column 10 against bending stress applied thereto, the reinforcing sheets C6 comprising reinforcing fibers, such as carbon fibers, aramid fibers, glass fibers, and the like are respectively joined to all side surfaces of the column 10 so as to extend along the continuous direction, that is the vertical direction of the column 10. The top and bottom ends of the reinforcing sheet C6 are joined by the fixing anchors D4.

As shown in FIG. 5, the fixing anchor D4 comprises a large amount of reinforcing fiber F such as C.F., A.F., G.F. The center part of the fixing anchor is bundled with some crip or the like but both ends are free of bundles and can be spread.

After the fixing anchor D4 is impregnated with resin adhesives or the like, the anchor is inserted into the hole. And the both ends are respectively spread just like FIG. 8. After curing, the reinforcing fiber sheet C6 is applied onto the column 10 with the ends of the reinforcing sheet overlapped over the fixing anchor C6. In this way the upper reinforcing sheet C6 and the lower reinforcing sheet C6 are joined with the fixing anchor D4.

Furthermore, fixing reinforcing members 22 are superposed and attached so as to wrap around the column 10 at the portion where the reinforcing fiber f of the fixing anchor D4 and the reinforcing sheet C6 are superposed. This fixing reinforcing member 22 is made of material similar to the reinforcing sheet C6 and applied perpendicular to the reinforcing sheet C6. This fixing member works like stir-lap for confining the column 10, other than fixing the joints.

The effects similar to the effects obtained in the first example can be produced in the column 10 by the above structure for reinforcing column 10 and the reinforcing method.

Moreover, FIG. 8, used for explaining in the second example, shows that the reinforcing sheets C6 are arranged and joined to only the column 10 on the left side. However, it is certainly possible to arrange and join similarly the reinforcing sheets C6 to the column on the right side.

Furthermore, the fixing reinforcing members 20, 21, and 22 comprising reinforcing fibers are used in the first to third example; however, a steel plate and the like may be used as the reinforcing members 20, 21, and 22. In addition, if the reinforcing members 20, 21, or 22 is not necessary, it is possible to omit them.

FOURTH EXAMPLE

Reinforcement of a Beam joined with a Floor

Figure 9:
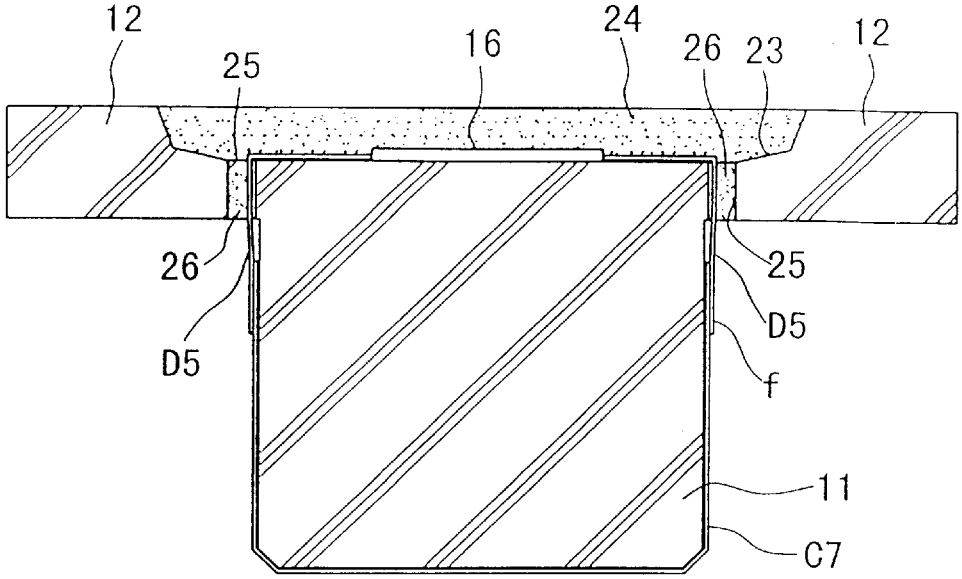
FIG. 9 shows the fourth example of the structure for reinforcing a concrete member and the reinforcing method according to the present invention, and is a longitudinal sectional view showing a reinforced beam joined with the floor using the reinforcing sheet.
Figure 9:
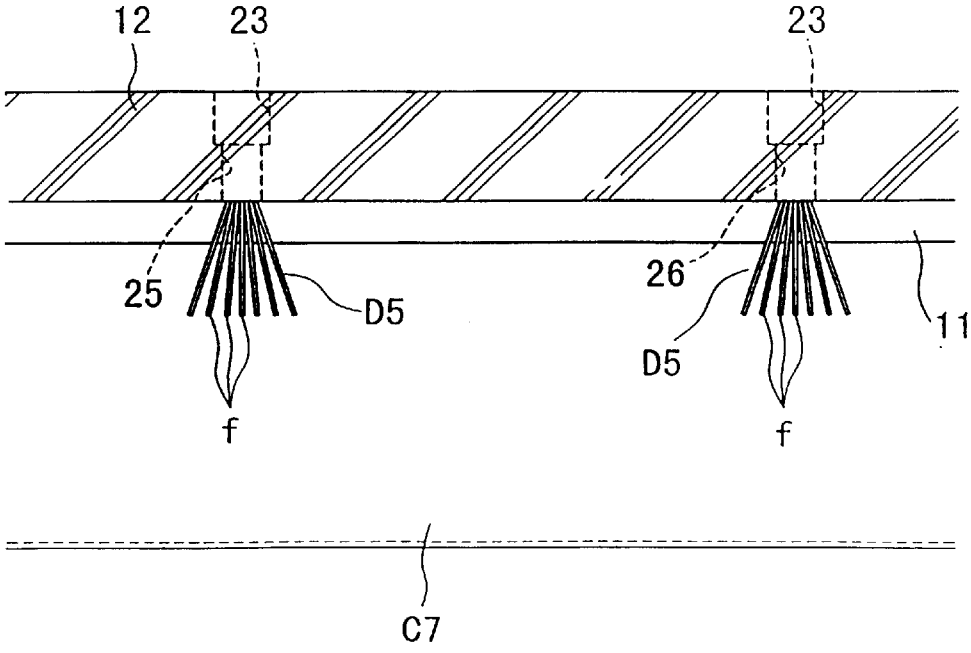

As shown in FIG. 9, the floor (being other concrete member) 12 is joined to the beam 11 in the upper side of the beam 11.

In order to reinforce the beam 11 against shearing stress applied thereto, the reinforcing sheet (reinforcing member) C7 is arranged and joined to the beam 11. The reinforcing sheet C7 comprises reinforcing fibers, such as carbon fibers, aramid fibers, glass fibers, and the like. The fiber alignment direction (corresponding to the weaving direction when the reinforcing fibers are in the form of a cloth) of the reinforcing sheet C7 is applied in order to get the confining effect.

The reinforcing sheet C7 is attached so as to wrap the under surface and both side surfaces of the beam 11 at under side of the floor 12 integrally joined to the beam 11. Both edges of the reinforcing sheet C7 are joined by the fixing anchors D5 in the vicinity of the joint portion between the beam 11 and the floor 12.

The fixing anchor D4 comprises a large amount of reinforcing fiber F such as C.F., A.F., the G.F. The center part of the fixing anchor is bundled with some crip or the like but both ends are free of bundles and can be spread.

The groove (recess portion) 23 is formed in the floor 12 in the upper side of the beam 11 before the fixing anchor application. As shown in FIG. 9, after the resin adhesive impregnation, the fixing anchor D5 is applied to the upper side of the beam 11, and then the both ends are to be inserted into the holes 25 and respectively spread on to the side surfaces of the beam 11. The groove 23 is filled with hardening fillers, such as mortar, and the like after the fixing anchor application. Thereby, the fixing anchor D5 is integrally joined to the beam 11.

The penetration holes 25 passing through the floor 12 are formed to both sides of the beam 11. The unbundled portions at both ends of the fixing anchor D5 are inserted through the penetration hole 25 and led to the opposite side (namely under side) of the floor 12. Resin 26, and the like, is poured and filled into the penetration hole 25.

The reinforcing fiber f at both ends of the fixing anchor D5 joined in the above manner are spread to the reinforcing sheet C7 attached to the surface of the beam 11 in the under side of the floor 12. Then, these reinforcing fibers f and the reinforcing sheet C7 are attached using an adhesive.

Both ends of the reinforcing sheet C7 extending in the circumferential direction of the beam 11 are joined, via the fixing anchor D5. The fixing anchor D5 and the reinforcing sheet C7 wrap around the beam 11.

In order to obtain the structure comprising the reinforced beam 11, the groove 23 is formed in the floor 12 in the upper side of the beam 11, and then the penetration holes 25 are formed in the floor 12.

After that, the fixing anchor D5 is set in the groove 23, both ends of the fixing anchor D5 are inserted through the penetration holes 25 and 25, and led under the floor 12. Both ends of the fixing anchor D5 are attached to both ends of the reinforcing sheet C7. Then a filler 16 is poured and filled in the penetration holes 25. Furthermore, the groove 23 is filled with a hardening filler 24.

According to the reinforcing method and the reinforced structure of the beam 11 joined with the floor 12, the reinforcing sheet C7 having reinforcing effects in the circumferential direction of the beam 11 is joined to the beam 11 by attaching both edges of the reinforcing sheet C7 to the fixing anchor D5 joined to the beam 11. In this way, it is possible to securely join both ends of the reinforcing sheet C7 by using the fixing anchor D5. The peeling of the edges of the reinforcing sheet C7 can be prevented. In addition, the entire circumference of the beam 11 is wrapped with the reinforcing sheet C7 and the fixing anchor D5; therefore, it is also possible to exert reliably reinforcing effects on the beam 11 against shearing stress applied thereto.

Moreover, in this case the fixing anchor D5 is put into the groove 23 formed in the upper side of the beam 11: therefore, the finished surface is flat. When facings are arranged and joined on the upper surface of the beam 11, the finished size of the beam 11 does not increase, and the height of the floor does not increase. Fixing the facings does not require significant time. In addition, the grooves 23 are filled with a hardening filler 24; therefore, the fixing anchors D5 comprising combustible materials do not protrude from both surfaces of the floor 12. Consequently, fire protecting performance of the structure should be of no problem.

During a reinforcing construction, the only noise source of the construction comes from digging grooves 23 and drilling the penetration holes 25, and the diameter thereof is smaller than the diameter of the conventional anchors, it is possible to minimize the noise and the vibration. Therefore, it is possible to easily adopt the structure for reinforcing the beam joined to the floor and the reinforcing method to existing buildings.

Furthermore, the reinforcing sheet C7 and the fixing anchor D5 are light; therefore, handling them during the execution is easy, and it is possible to decrease the labor imposed on the workers. Moreover, heavy machineries like cranes are not necessary; therefore, the construction can be smoothly performed even inside of existing building and the like.

Moreover, the corners of the beam 11 and the penetration hole 25 where the reinforcing sheet C7 and the fixing anchor D5 contact, may be chamfered in the fourth example.

Figure 10:
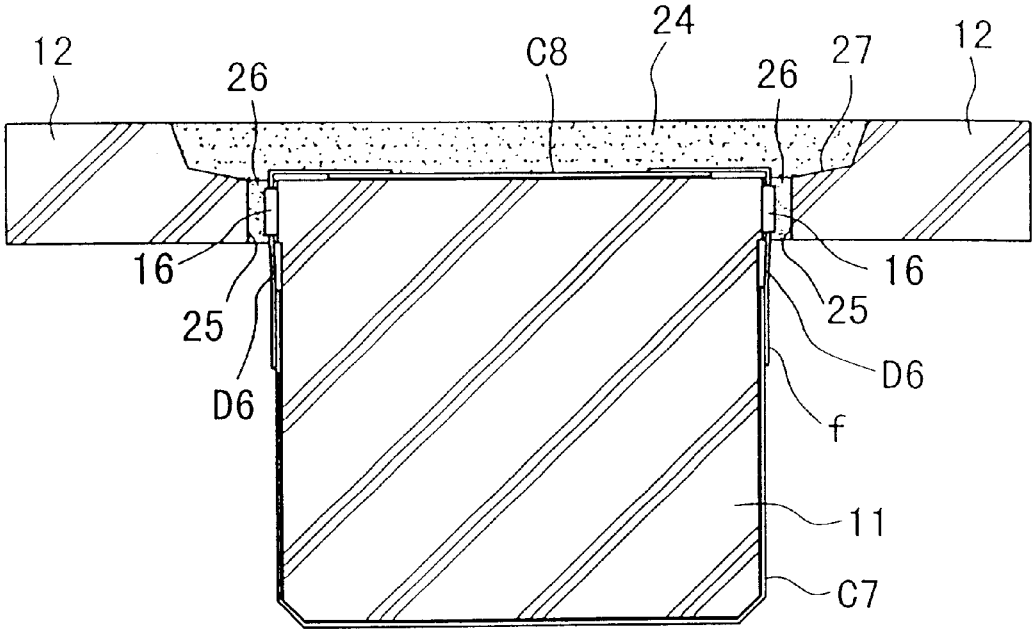
FIG. 10 shows the other fourth example of the structure for reinforcing a concrete member and the reinforcing method according to the present invention, and is a longitudinal sectional view showing a reinforced beam joined with the floor using the reinforcing sheet.

The reinforcing sheet C7 is securely joined by attaching both ends of the fixing anchor D5 to both edges of the reinforcing sheet C7 in the fourth example. However, as shown in FIG. 10, it is possible to arrange the reinforcing sheet C8 (reinforcing member) also on the upper surface of the beam 11, and integrally join the reinforcing sheets C7 and C8, via the fixing anchors D6 shown in FIG. 5, instead of the fourth example. In this case, a recess 27 extending along the axis of the beam 11 is formed, instead of the grooves 23 (referring to FIG. 9). Then the reinforcing sheet C8 is arranged in the recess 27, then the recess 27 is filled with a hardening filler 24. The fixing anchors D6 are attached so that the center bundled portions 16 are positioned into the penetration holes 25, and the unbundled portions at both ends are spread and attached to the reinforcing sheets C7 and C8 using an adhesive. Of course, the continuing recess 27 is not applied only to this example shown in FIG. 10. The continuing recess 27 can be applied, instead of the grooves 23 positioned at a given interval.

Moreover, the circumference of the beam 11 is wrapped with the reinforcing sheet C7 and the fixing anchor D5 in the fourth example. However, it is possible to use one set comprising two the fixing anchors D5' as shown in FIG. 3, for example. In this case, the fixing anchors D5' are respectively arranged at both ends of the groove 23. The bundled portion 15 is joined in the groove 23 (referring to FIG. 9). The unbundled portions are passed through the penetration holes 25, and led below, similarly to the fixing anchor D5 (referring to FIG. 9). Moreover, in this case, it is also possible to form grooves in the floor 12 on both sides of the upper side of the beam 11, and join the fixing anchors D5' in the grooves.

In addition, it is also possible to impregnate bundles of reinforcing fibers in an adhesive or resin in construction site. Furthermore, bundles of reinforcing fibers may be applied onto the beam 11 by arranging reinforcing fiber f in the penetration hole 25 and groove 23 leaving the reinforcing fibers unbundled, filling the penetration hole 25 with a resin 26, filling the groove 23 with a hardening filler 24, thereby bundling a part of a plurality of reinforcing fibers in the longitudinal direction. In this manner, it is not necessary to make in advance the fixing anchors D5 and D6 comprising a plurality of bundled reinforcing fibers; therefore, a lower cost can be achieved. In addition, the number or length of the reinforcing fibers can also be easily changed in construction site; therefore, the reinforcing construction can be more easily performed.

Application Examples of the First to Fourth Examples

The structures in which the floor 12 is integrally formed on the upper surface of the beam 11 were explained in the first to fourth examples. These structures can be applied when columns intersecting beams or walls, and the like are reinforced.

The floor 12 joined to the beam 1, the beam 11 joined to the column 10, and the wall 13 joined to the column 10 may be only one, three, or four. Moreover, the joint position between them is not limited. The positional relationships between the column 10 and the wall 13, and the beam 11 and the floor 12 are not limited. For example, a positional relationship between the column 10 and the wall 13 may be the positional relationship between the beam 11 and the floor 12 as shown in FIGS. 4(*b*), (*d*), (*f*), and (*g*). In addition, when the structure for reinforcing a concrete member and the reinforcing method are applied to a part of a column, beam, wall, floor, or the like where another member is not joined, effects similar to those obtained in the above examples can be obtained by wrapping the reinforcing sheet to the part of a column, beam, wall, floor, or the like, forming a groove or recess in its surface, and embedding the fixing anchor.

Moreover, the column 10 and beam 11 are used in the structure for reinforcing a concrete member and the reinforcing method of the present invention in the first to fourth examples. However, it is certainly possible to use a bent, stack, or the like. In addition, in this case, whether the concrete member is in a new or existing construction does not matter.

FIFTH EXAMPLE

Shearing Reinforcement of a Wall

Figure 11:
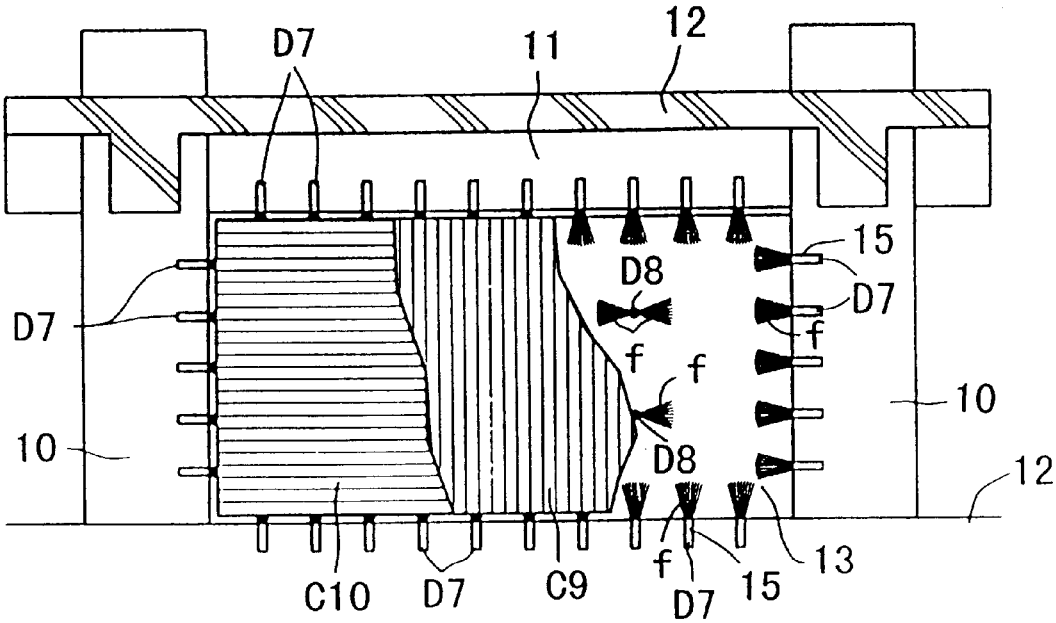
FIG. 11 shows the fifth example of the structure for reinforcing a concrete member and the reinforcing method according to the present invention, and is a longitudinal sectional view showing a reinforced wall using the reinforcing sheet.

As shown in FIG. 11, the reinforcing sheets C9 and C10 for reinforcing the wall 13 against shearing stress applied thereto are arranged and joined substantially to the whole wall 13. These reinforcing sheets C9 and C10 comprise reinforcing fibers, such as carbon fiber, aramid fiber, glass fiber, and the like. In order to obtain the reinforcing effects on the vertical direction (reinforcing sheet C9), and the horizontal direction (reinforcing sheet C10), the fiber alignment direction (corresponding to the weaving direction when the reinforcing fibers are in the form of a cloth) of the reinforcing sheets C9 and C10 is set.

Not only whole the reinforcing sheet C9 is directly attached to the wall 13, but the edges of the reinforcing sheet C9 are joined to the column 10, beam 11, and floor 12 surrounding the wall 13 by the fixing anchors D7, and to the wall 13, via the fixing anchors D8.

As shown in FIG. 3, the fixing anchors D7 and D8 comprise a large amount of reinforcing fiber f, such as carbon fibers, ararnid fibers, glass fibers, and the like, and is obtained by bundling the reinforcing fibers f at a bundled portion 15 on the proximal end part side using an adhesive or resin, for example. The reinforcing fibers f are not bundled on the distal end part side.

As shown in FIG. 11, the fixing anchors D7 are embedded into the column 10 and the beam 11 by pushing the bundled portion 15 into holes (not shown in the figure) formed in the column 10, the beam 11, and the floor 12 and filling the holes (not shown in the figure) with an adhesive, and the like.

The reinforcing fibers f in the distal end part of the fixing anchors D7 joined in the above manner are respectively spread along the surface of the wall 13. The reinforcing sheet C9 is over-lapped to the reinforcing fibers f at the distal end parts. Then, these fixing anchors D7 and the reinforcing sheet C9 are adhered with an adhesive.

Figure 12:
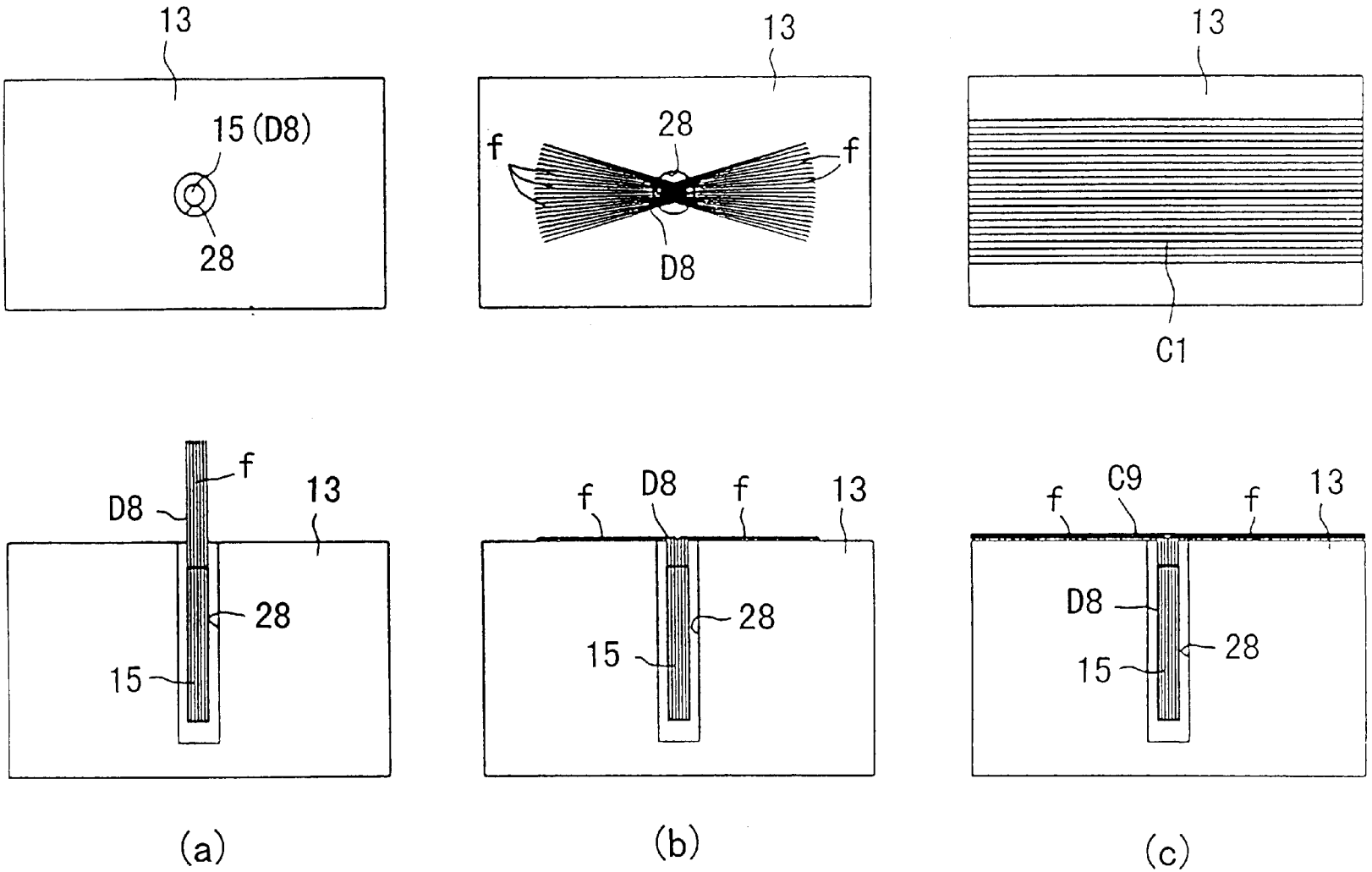
FIG. 12 is a view showing the process for joining the reinforcing sheet.

Moreover, as shown in FIG. 12(*a*), the fixing anchor D8 is joined to the wall 13 by inserting the bundled portion 15 into a hole 28 formed in the wall 13 and filling the hole 28 with an adhesive, and the like. As shown in FIG. 12(*b*), the reinforcing fibers f in the distal end part of the fixing anchor D8 are spread along the surface of the wall 13. Then, as shown in FIG. 12(*c*), the reinforcing sheet C9 covers the reinforcing fibers f at the distal end part, and the fixing anchor D8 and the reinforcing sheet C9 are attached with an adhesive.

Thereby, as shown in FIG. 11, the reinforcing sheet C9 is joined to the column 10, beam 11, floor 12, and wall 13, via the fixing anchors D7 and D8. Furthermore, the whole reinforcing sheet C10 having reinforcing effects in the perpendicular direction to the reinforcing direction of the reinforcing sheet C9, is applied to the surface of the reinforcing sheet C9 using an adhesive, or the like.

According to the structure for reinforcing the wall 13 against shearing stress applied thereto and the reinforcing method, the reinforcing sheet C9 is joined to the column 10, beam 11, floor 12, and wall 13, via the fixing anchors D7 and D8. Thereby, it is possible to improve the ductility and proof stress against shearing stress of the wall 13 by securely joining the reinforcing sheet C9 to the wall 13. In addition, even when the reinforcing sheets C9 and C10 are applied on only one surface of the wall 13, sufficient reinforcing effects can be obtained. Therefore, it is possible to exert these reinforcing effects in places which have been difficult to reinforce, such as an elevator shaft, exterior wall, staircase, and the like.

Moreover, during a reinforcing construction, the only source of the construction noise and the vibration is just the drilling the holes 28, and the holes 28 have a smaller diameter than the diameter of the conventional anchors, it is possible to minimize the noise and the vibration. Therefore, it is possible to easily adopt the structure for reinforcing a wall and the reinforcing method to existing buildings. There remains no protrusion at the surface of the reinforcing sheets C9 and C10. Fixing the facings does not require significant time.

SIXTH EXAMPLE

Another Example of a Shearing Reinforcement of a Wall

Only the reinforcing sheet C9 directly attached to the wall 13 is joined by the fixing anchors D7 and D8 in the fifth example. In contrast, both reinforcing sheets C9 and C10 are joined by the fixing anchors D7 and D8 in the following sixth example.

Figure 13:
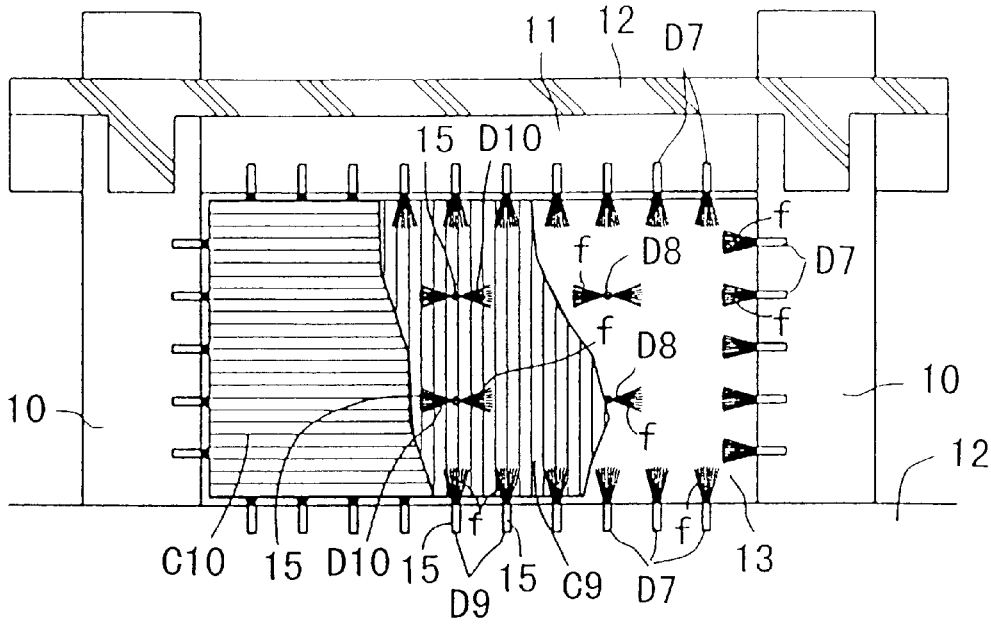
FIG. 13 shows the sixth example of the structure for reinforcing a concrete member and the reinforcing method according to the present invention, and is a longitudinal sectional view showing a reinforced wall using the reinforcing sheet.

As shown in FIG. 13, the reinforcing sheets C9 and C10 for reinforcing the wall 13 against shearing stress applied thereto are arranged and joined substantially to the whole wall 13.

The edges of both the reinforcing sheets C9 and C10 are joined to the column 10, beam 11, and floor 12 surrounding the wall 13, by the fixing anchors D7 and D9. In addition, the reinforcing sheets C9 and C10 are joined to the wall 13 by the fixing anchors D8 and D10.

In order to obtain the structure, the bundled portions 15 of the fixing anchors D7 and D8 for joining the reinforcing sheet C9 are respectively joined to the column 10, beam 11, floor 12, and wall 13. The reinforcing sheet C9 is attached to the wall 13 by attaching to the surface of the wall 13 and joining to the reinforcing fibers f of the fixing anchors D7 and D8. Then, the bundled portions 15 of the fixing anchors D9 are joined in the holes (not shown in the figure) embedded in the column 10, beam 11, and floor 12. The holes (not shown in the figure) are formed in the wall 13 by penetrating the reinforcing sheet C9. The bundled portion 15 of the fixing anchor D10 is joined in the hole (not shown in the figure). The reinforcing fibers f at the unbundled portion of the fixing anchors D9 and D10 are spread on the surface of the reinforcing sheet C9. Then, the reinforcing sheet C10 is attached to the reinforcing fibers f using an adhesive and the like.

Thereby, not only the reinforcing sheet C9, but the reinforcing sheet C10 applied on the reinforcing sheet C9 is joined, via the fixing anchors D9 and D10.

According to this structure for reinforcing the wall 13 against shearing stress applied thereto, and the reinforcing method, not only the reinforcing sheet C9, but the reinforcing sheet C10, having reinforcing effects against shearing stress in the direction perpendicular to the reinforcing direction of the reinforcing sheet C9, is securely joined to the wall 13. Therefore, more notable effects can be obtained in this example than the effects obtained in the fifth examples.

SEVENTH EXAMPLE

Bending Reinforcement of a Floor

Figure 14:
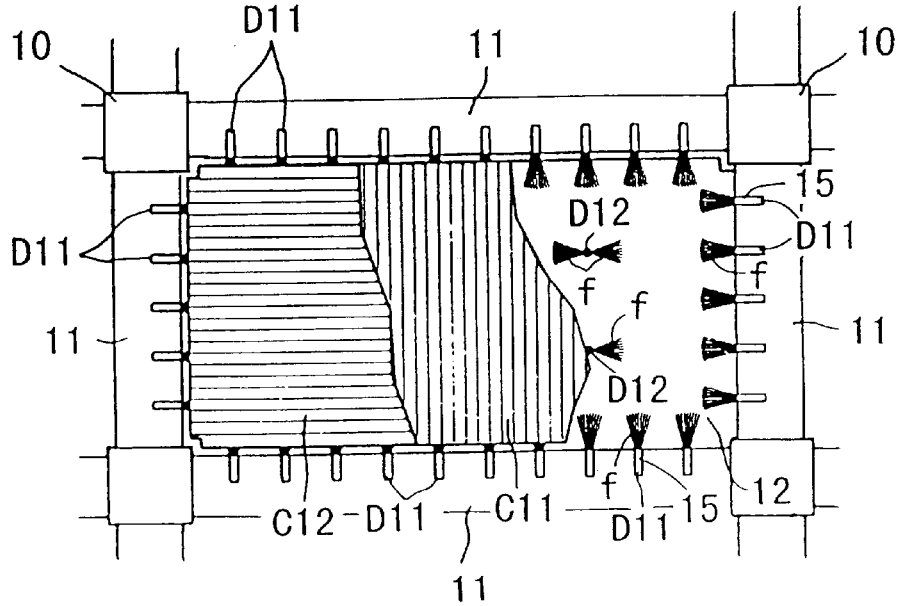
FIG. 14 shows the seventh example of the structure for reinforcing a concrete member and the reinforcing method according to the present invention, and is a longitudinal sectional view showing a reinforced floor using the reinforcing sheet.

As shown in FIG. 14, the reinforcing sheets C11 and C12 for reinforcing the floor 12 against bending stress applied thereto are arranged and joined substantially to the whole under surface of the floor 12, for example.

Not only does the whole reinforcing sheet C11 directly adhere to the floor 12, but the edges thereof are joined to the beam 11 surrounding the floor 12 by the fixing anchors D1 1, and to the floor 12 by the fixing anchors D12.

The fixing anchor D11 is joined by inserting the bundled portion 15 into a hole (not shown in the figure) formed in the beam 11 and filling the hole (not shown in the figure) with an adhesive, and the like.

The fixing anchor D12 is joined to the floor 12 by inserting the bundled portion 15 into a hole (not shown in the figure) formed in the floor 12 and filling the hole (not shown in the figure) with an adhesive, and the like.

The reinforcing fibers f in the distal end part of the fixing anchors D11 and D12 joined in the above manner, are spread along the surface of the floor 12. The reinforcing sheet C11 covers the reinforcing fibers fat the distal end part. Then, these fixing anchors D11 and D12 and the reinforcing sheet C11 are attached with an adhesive, and the like.

The whole reinforcing sheet C12 having reinforcing effects in the direction perpendicular to the reinforcing direction of the reinforcing sheet C11, is attached to the reinforcing sheet C11 using an adhesive, and the like.

According to the structure for reinforcing the floor 12 against bending stress applied thereto, it is possible to improve the ductility and proof stress against bending stress of the floor 12 by securely joining the reinforcing sheet C11 to the floor 12. In addition, regarding to the effects during construction, the effects similar to those obtained in the fifth or sixth example can be obtained in this example.

Figure 15:
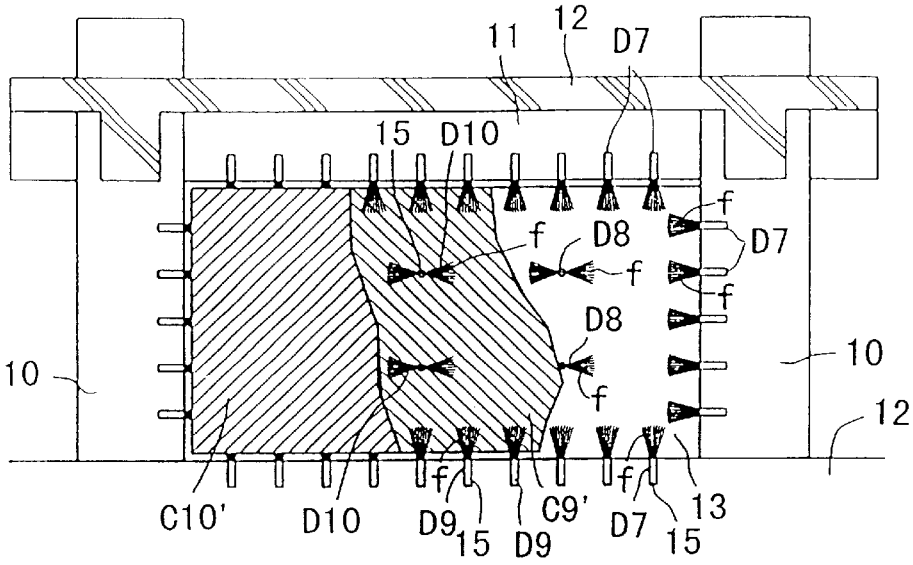
FIG. 15 shows the other sixth example of the structure for reinforcing a concrete member and the reinforcing method according to the present invention, and is a longitudinal sectional view showing a reinforced wall using the reinforcing sheet.

Moreover, the reinforcing sheets C9 to C12 are arranged and joined so as to obtain the reinforcing effects in the horizontal and vertical directions in the fifth to seventh examples. However, it is certainly possible to arrange and join each of the reinforcing sheets C9 and C11 and the reinforcing sheets C10 and C12 so as to obtain the reinforcing effects in only the horizontal direction or only the vertical direction. As far as reinforcing effects can be exerted in a desired direction, the fiber alignment direction may take any direction, such as a horizontal direction, vertical direction, diagonal direction, and the like. In addition, the fiber alignment directions of the reinforcing sheets C9' and C10', as shown in FIG. 15, may be changed. Of course, the number of the superposed reinforcing sheet is not limited.

EIGHTH EXAMPLE

Shearing Reinforcement of a Wall

Figure 16:
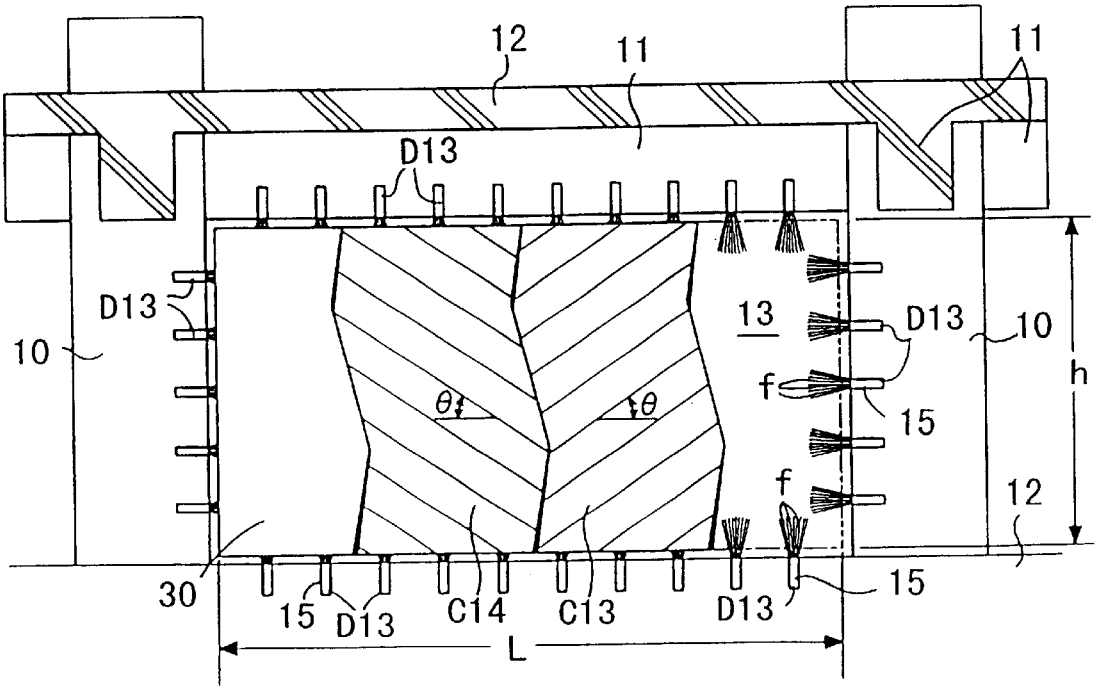
FIG. 16 shows the eighth example of the structure for reinforcing a concrete member and the reinforcing method according to the present invention, and is a longitudinal sectional view showing a reinforced wall using the reinforcing sheet.

As shown in FIG. 16, the reinforcing sheets C13 and C14 for reinforcing the wall 13 against shearing stress applied thereto are superimposed, and attached substantially to the whole wall 13. These reinforcing sheets C13 and C14 comprise reinforcing fibers such as carbon fibers, and the like, which are aligned at a direction (in the figure, a oblique line shows a alignment direction of the reinforcing fibers). The reinforcing sheets C13 and C14 are arranged so that the fiber alignment directions thereof are oblique and intersected. An angle θ between the fiber alignment directions of the reinforcing sheets C13 and C14 may be in 0°<<90°; however, preferably within 45°.

Not only does the whole reinforcing sheet C13 directly adheres to the wall 13, but the edges thereof are joined to the column 10, beam 11, and wall 12 surrounding the wall 13 by the fixing anchors D13.

The fixing anchor D13 comprises a large number of reinforcing fibers f, such as carbon fibers, and the like, and is obtained by bundling the reinforcing fibers at a bundled portion 15 on the proximal end part side using an adhesive or resin, for example. The reinforcing fibers f are not bundled on the distal end part side.

The fixing anchors D13 are joined to the column 10, beam 11, and floor 12 by inserting the bundled portion 15 into holes (not shown in the figure) formed in the column 10, beam 11, and floor 12, and filling the holes (not shown in the figure) with a resin, and the like.

The reinforcing fibers f in the distal end part of the fixing anchor D13 which is joined in the above manner are spread along the surface of the wall 13. The reinforcing sheet C13 covers the reinforcing fibers fat the distal end part. The reinforcing sheet C13 covers the reinforcing fibers fat the distal end part. Then, the fixing anchors D13 and the reinforcing sheet C13 are adhered with a resin.

Thereby, the reinforcing sheet C13 is joined to the column 10, beam 11, floor 12, and wall 13, via the fixing anchors D13.

Moreover, on the whole upper surface of the reinforcing sheet C13, the reinforcing sheet C14 having reinforcing effects in the oblique direction intersected with the reinforcing direction of the reinforcing sheet C13 is attached using an adhesive, and the like.

Furthermore, on the upper surface of the reinforcing sheet C14, stiffeners 30 such as mortar, and the like are coated or piled so as to have a thickness, and are integrally jointed to the reinforcing sheet C14.

According to the structure for reinforcing the wall 13 against shearing stress applied thereto, the reinforcing sheets C13 and C14 of which the fiber alignment directions are oblique and intersected, are joined to the surface of the wall 13. Thereby, the reinforcing sheets C13 and C14 having oblique fiber alignment directions exert functions similar to those of a brace. The ductility and proof stress against shearing stress of the wall 13 can be improved. Therefore, the earthquake resistance of buildings can be improved. In addition, even when the reinforcing sheets C13 and C14 are arranged and joined on only one surface of the wall 13, sufficient effects can be obtained. Therefore, it is possible to reinforce in the places which have been difficult to reinforce such as an elevator shaft, exterior wall, staircase, and the like The construction can be easily performed by using the reinforcing sheets C13 and C14 comprising reinforcing fibers. The materials are light, and therefore, the labor imposed on the workers is also light. Jacks are not necessary. As a result, the construction periods and the cost can be decreased.

The reinforcing sheets C13 and C14 are thin; therefore, the thickness of the wall does not increase after the construction. The decrease of the size of a room can be prevented.

The reinforcing sheets C13 and C14 comprise reinforcing fibers, and they are extremely light. It is possible to minimize the weight increase of the structure after reinforcement. Therefore, reinforcing effects do not substantially decrease due to a weight increase by the reinforcement, and the reinforcing effects can be effectively exerted.

The reinforcing sheet C13 is joined to the column 10, beam 11, floor 12, and wall 13, via the fixing anchors D13. Thereby, the reinforcing sheet C13 to the wall 13 can be securely joined.

During the hole for the fixing anchor is the only source of the noise and the vibration, and also the holes are smaller than those of the conventional steel anchors, we can minimize the construction noise and vibration. Therefore, the reinforcing method can be easily adopted easily to existing buildings. There remains no protrusion at the surface of the reinforcing sheets C13 and C14, after the reinforcing sheets C13 and C14 are arranged and joined. Fixing the facings on the reinforcing sheets C13 and C14 does not require significant time.

In addition, in order to improve the stiffness of the reinforcing sheets C13 and C14, the stiffener 30 such as mortar and the like is integrally joined to the surface of the reinforcing sheets C13 and C14. Thereby, the effective thickness of the reinforcing sheets C13 and C14 increases.

The horizontal stress bearing capacity of the carbon fiber sheet is shown by the following formula:

$$\Delta Q=(h\cdot\cos\theta+L\cdot\sin)\cdot tcf\cdot\sigma cf\cdot\cos\theta$$

wherein L denotes the width of the reinforcing sheets C13 and C14, h denotes the height of the reinforcing sheets C13 and C14, t c f denotes the total thickness of the carbon fiber sheet in a direction, and σc f denotes the effective strength of the carbon fiber sheet.

When the stiffener 30 is used, the effective thickness (total thickness) of the reinforcing sheets C13 and C14 is increased, and the effective strength (stiffness) of the reinforcing sheets C13 and C14 can be improved. Therefore, brace effects, that is, the reinforcing effects to the wall 13, can be increased.

NINTH EXAMPLE

Bending Reinforcement of a Floor

Figure 17:
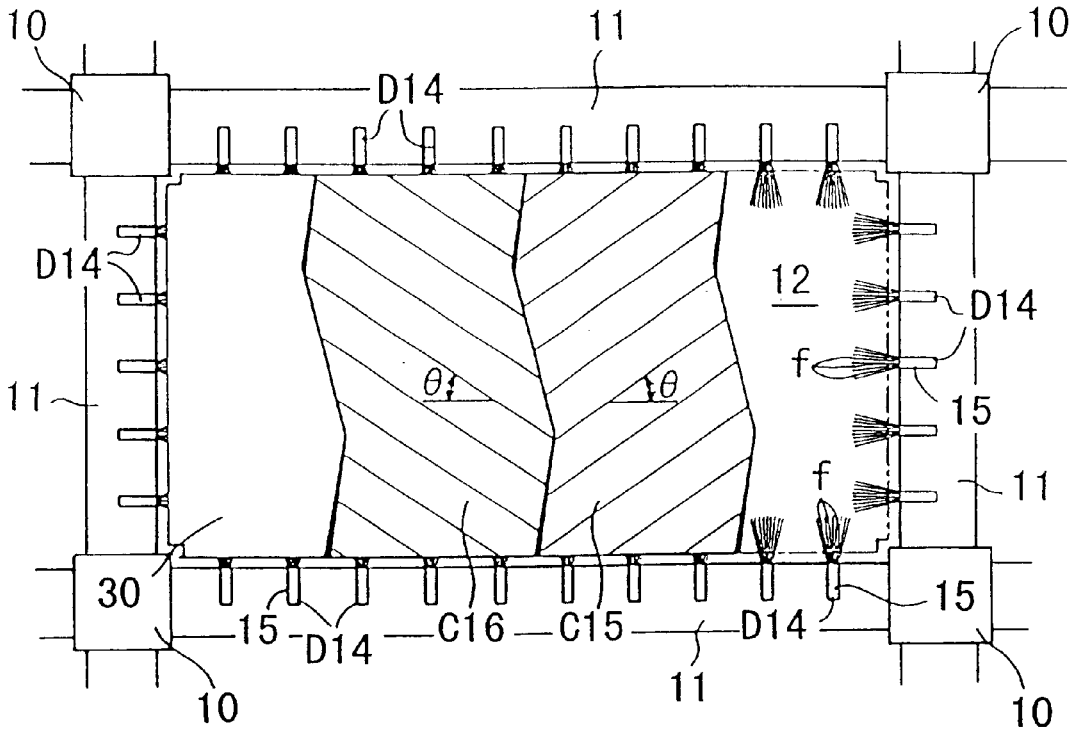
FIG. 17 shows the ninth example of the structure for reinforcing a concrete member and the reinforcing method according to the present invention, and is a longitudinal sectional view showing a reinforced floor using the reinforcing sheet.

As shown in FIG. 17, the reinforcing sheets C15 and C16 for reinforcing the floor 12 (a concrete member in the form of a plate) against bending stress applied thereto are arranged and joined substantially over the entire under surface of the floor 12, for example.

Both of these reinforcing sheets C15 and C16 comprise reinforcing fibers such as carbon fibers, and the like, which are aligned at a direction (in the figure, a oblique line shows an alignment direction of the reinforcing fibers). The reinforcing sheets C15 and C16 are arranged so that their fiber alignment directions are oblique and intersected. An angle θ between the fiber alignment directions of the reinforcing sheets C15 and C16 may be in $0°<\theta<90°$, preferably within $\theta \leqq 45°$.

Not only is the whole reinforcing sheet C15 directly attached to the floor 12, but the edges of the reinforcing sheet C15 are joined to the beam 11 surrounding the floor 12 by the fixing anchors D14.

The fixing anchor D14 is joined to the beam 11 by inserting the bundled portion 15 into holes (not shown in the figure) formed in the beam 11, and filling the holes (not shown in the figure) with an adhesive, and the like.

The reinforcing fibers f in the distal end part of the fixing anchor D14 joined in the above manner, are spread along the surface of the floor 12. The reinforcing sheet C15 covers the reinforcing fibers f at the distal end part. Then, the fixing anchors D14 and the reinforcing sheet C15 are attached with an adhesive, or the like.

On the upper surface of the reinforcing sheet C15, the entire reinforcing sheet C16 having reinforcing effects in the direction perpendicular to the reinforcing direction of the reinforcing sheet C15, is attached using an adhesive, and the like.

According to the structure for reinforcing the floor 12 against bending stress applied thereto, the reinforcing sheet C15 can be securely joined to the floor 12. The reinforcing sheets C15 and C16 exert the functions similar to those of a brace. The ductility and proof stress against bending stress of the floor 12 can be improved. Regarding to the effects during construction, the effects similar to the effects obtained in the eighth example, can be obtained in this example.

Moreover, two reinforcing sheets C13 and C14, and C15 and C16 are superimposed in the eighth and ninth examples. However, only one reinforcing sheet may be used, or three or more reinforcing sheets may be superimposed, depending on desired reinforcing effects.

In addition, only the reinforcing sheets C13 and C15 are joined by the fixing anchors D13 and D14, and the reinforcing sheets C14 and C16 are attached to the reinforcing sheets C13 and C15 in the eighth and ninth examples. However, the fixing anchors D13 and D14 may be used to join the edges of the reinforcing sheets C14 and C16.

Of course, the superimposing order (top and bottom relationship) of these reinforcing sheets C13 to C16, and the fixing anchors D13 and 14 is not limited, but can be random.

Figure 18:
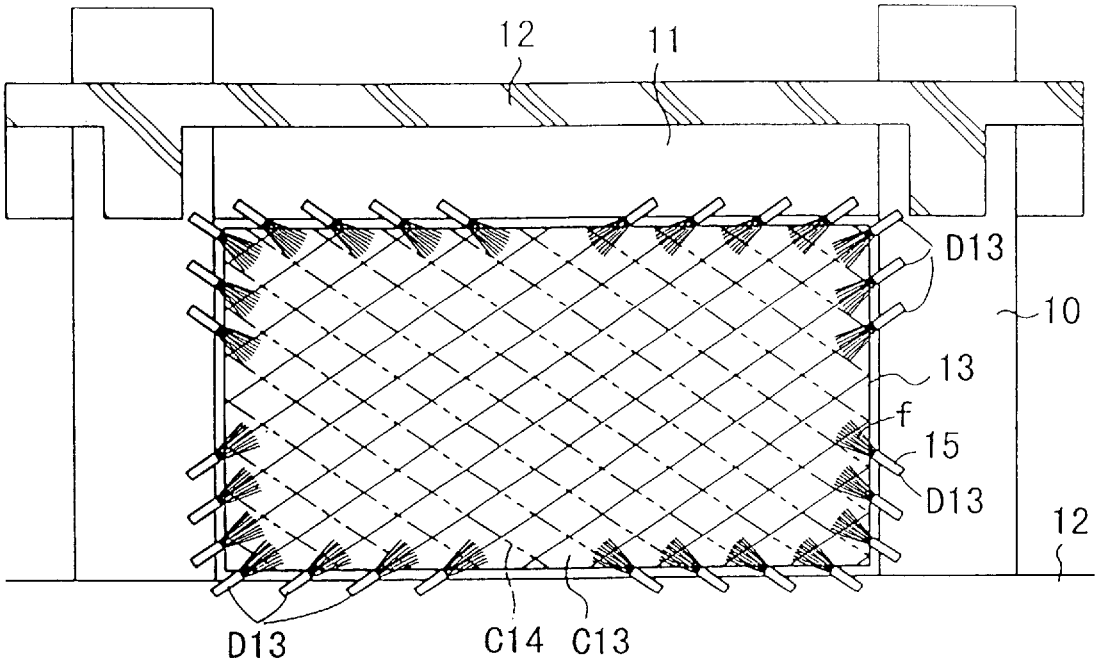
FIG. 18 shows the other eighth example of the structure for reinforcing a concrete member and the reinforcing method according to the present invention, and is a longitudinal sectional view showing a reinforced floor using the reinforcing sheet.
Figure 19:
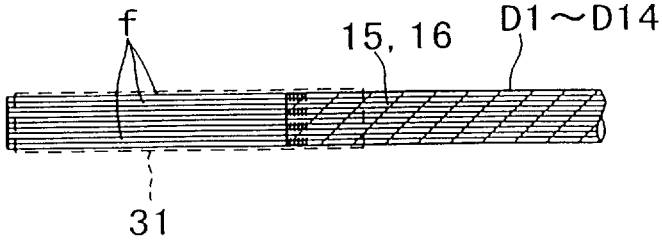
FIG. 19 is an outside view showing the other fixing anchor.

Moreover, the fixing anchors D13 and D14 are joined perpendicularly to the column 10, beam 11, and floor 12; however, they may be joined obliquely to them, as shown in FIG. 18. When the fixing anchors D13 and D14 are joined obliquely to them and the fixing anchors D13 are arranged and joined so as to correspond to the fiber alignment direction of the reinforcing sheets C13 and C14, it is possible to more effectively join both ends of the reinforcing sheets C13 and C14 in the fiber alignment direction.

The fixing anchors D13 and D14 are joined to the column 10, beam 11, and floor 12; however, it is not necessary to join the fixing anchors D13 and D14 to all of them. The fixing anchors D13 and D14 may be joined to at least one member selected from them.

Furthermore, in so far as the tensile strength of the reinforcing sheets C15 and C14 in the fiber alignment direction can be transmitted to the surrounding column 10, beam 11, and floor 12, the edges of the reinforcing sheets C15 and C14 may be pressed by steel members, such as an angle bar, flat bar, and the like, instead of the fixing anchors D13. Then, the steel members may be joined to the surrounding column 10, beam 11, and floor 12 by anchors made of metals.

Mortar is used as the stiffener 30, and is coated or piled to the surface of the reinforcing sheets C14 and C16 so as to have a required thickness. However, after mortar is coated or piled to the surface of the wall 13, the reinforcing sheets C13 to C16 may be attached to mortar. In particular, when there are facings comprising the mortar layer on the wall 13 are in existing buildings, it is possible to attach the reinforcing sheets C13 to C16 thereto, and the mortar layer functions as the stiffener 30. Furthermore, a concrete plate, iron plate, and the like can be used as the stiffener 30, instead of mortar. When the reinforcing sheets C13 to C16 comprise carbon fibers, in general, PAN sheets having elasticity can be used as carbon fibers. Pitch carbon fiber sheet having a large Young's modulus is superimposed and attached to the reinforcing sheets C13 to C16, as the stiffener 30. Of course, the stiffener 30 can be omitted.

The concrete members applied to the structure for reinforcing a concrete member and the reinforcing method of the present invention, are not limited to the floor and wall, as explained in the fifth to ninth examples. Whether the concrete member is in a new or existing construction does not matter. For example, the structure for reinforcing a concrete member and the reinforcing method of the present invention can adopt concrete molded products, such as a culvert, and the like. In addition to culvert, it is possible to adopt the structure and the reinforcing method of the present invention to concrete members in the form of curved surfaces, such as the inside surface of a tunnel, and the like. Consequently, the occurrence of cracks can be prevented.

Other Examples

The reinforcing fibers at the distal end part of the fixing anchors D1 to D14 are not bundled in the first to ninth examples. However, in order to prevent catching and breaking of the reinforcing fibers f during the constructions, the reinforcing fibers at the distal end part of the fixing anchors D1 to D14 may be wrapped with a cellophane, and the like.

Figure 20:
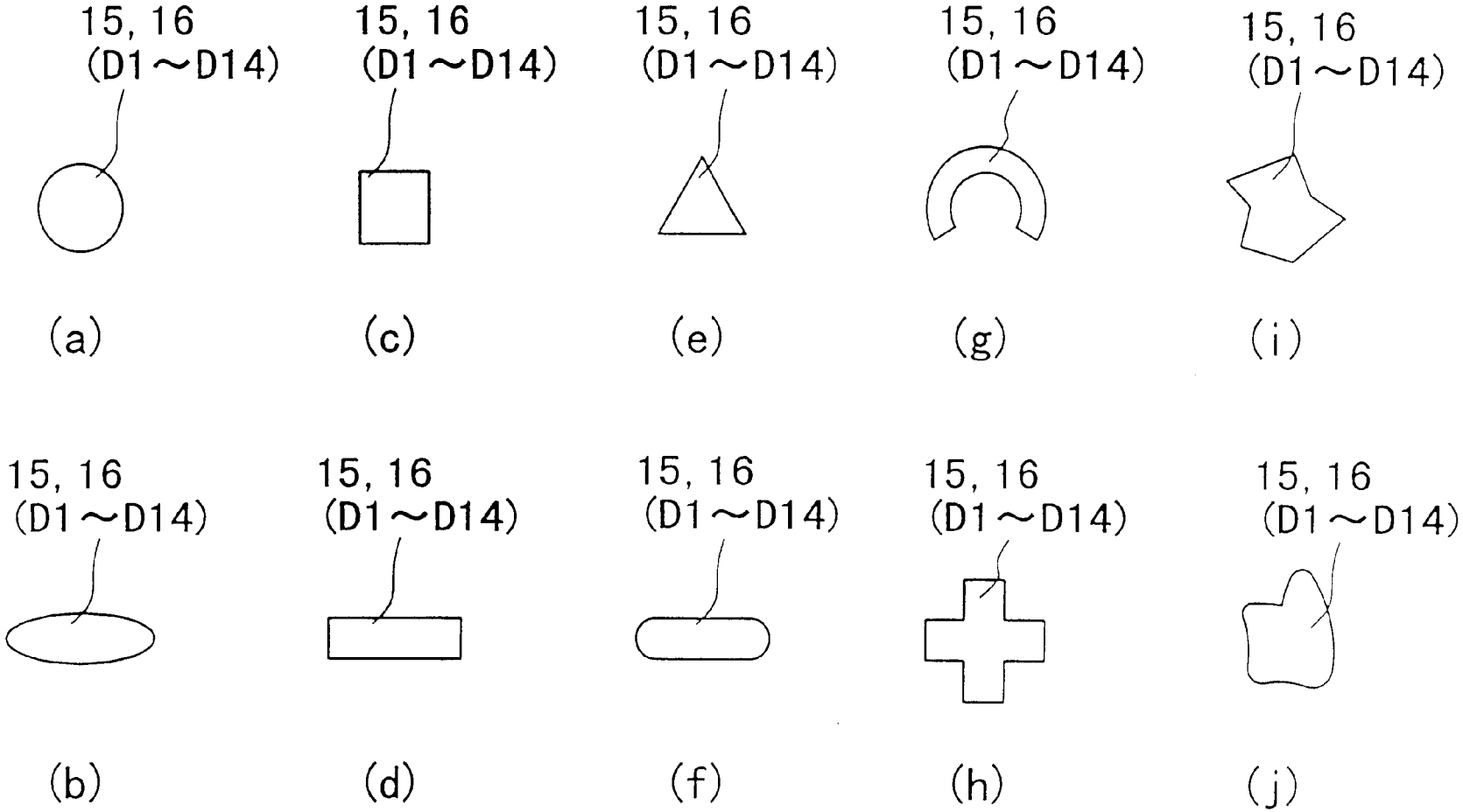
FIG. 20 is a view showing the application examples of the sectional shape of the fixing anchor.

The fixing anchors D1 to D14 comprise a large number of the bundled reinforcing fibers f which are made by making the bundled portion 15 or 16. The cross-sectional shape of the bundled portion 15 or 16 may be any shapes, such as a rectangle, triangle, ellipse, elongated shape with circular ends, C-shaped, cross-shaped, polygon, irregular shape, as shown in FIG. 20, in addition to a circle.

Figure 21:
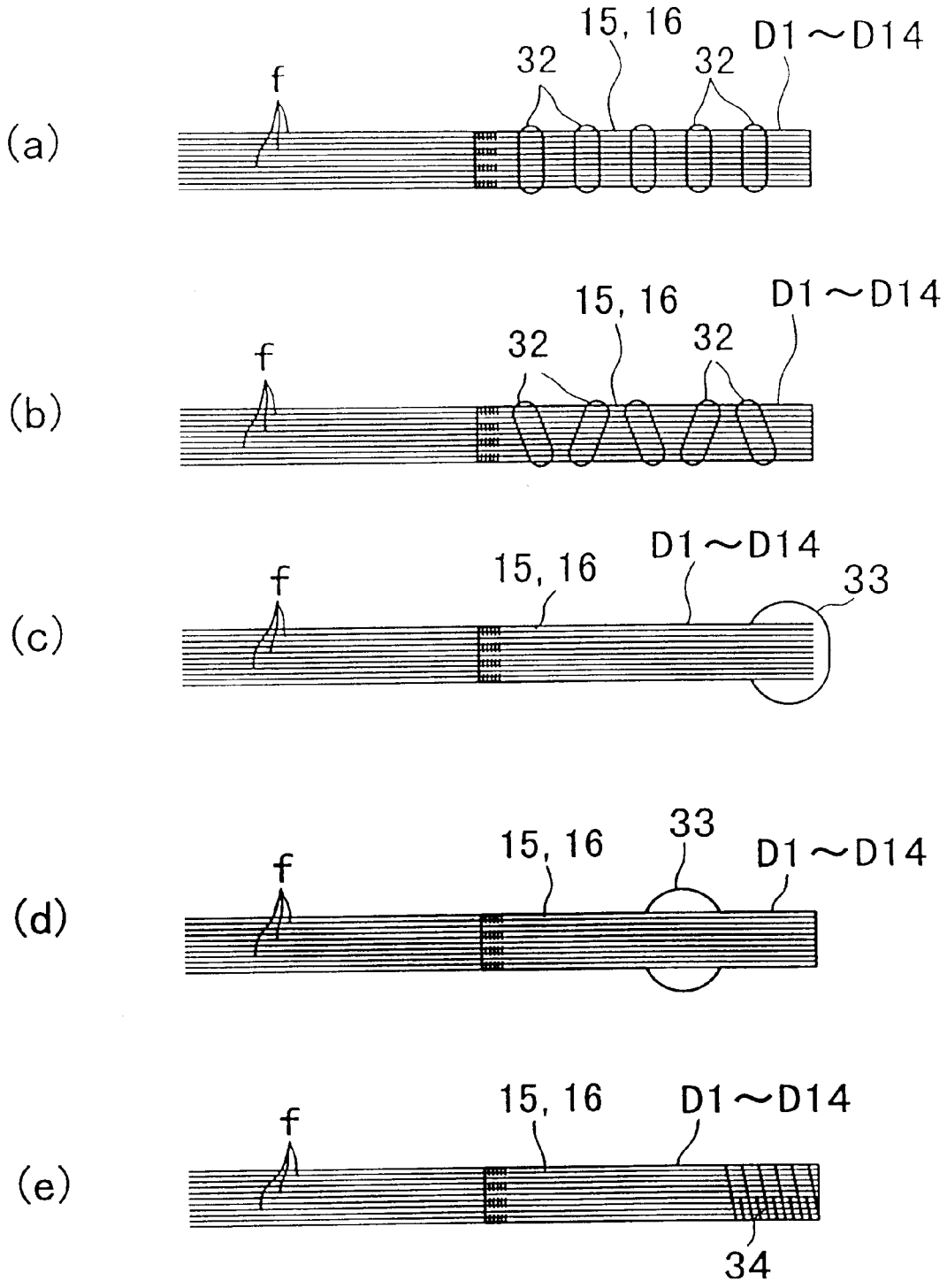
FIG. 21 is an outside view showing the other examples of the bundled portion of the fixing anchor.

Moreover, as shown in FIGS. 21(*a*) to (*d*), in order to securely join the fixing anchors D1 to D14, convex portions 32 or knobs 33 may be formed at the bundled portions 15 and 16. Of course, the shape, position, number, and the like of the convex portion 32 or knob 33 are not limited. As shown in FIG. 21(*e*), a screw portion 34 may be formed on the circumference at the end of the bundled portion 15, and a nut and the like may be driven in the screw portion 34.

Figure 22:
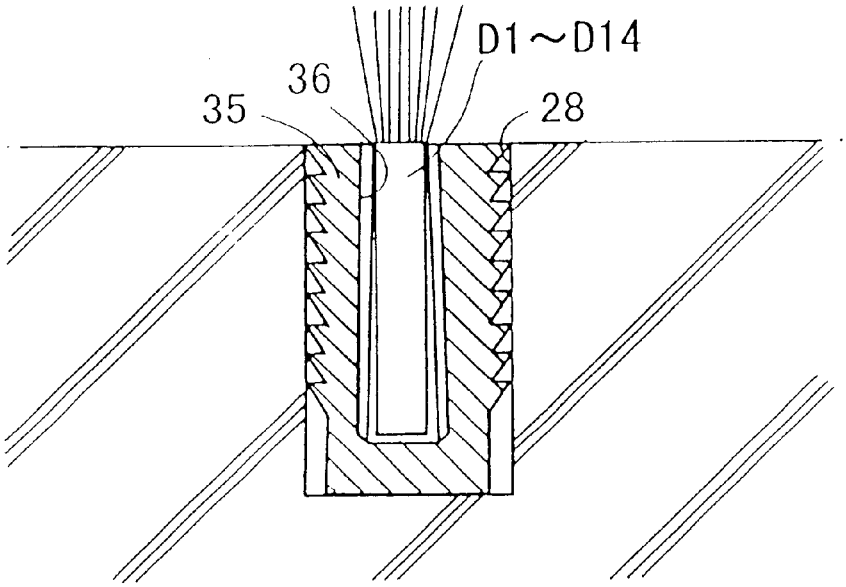
FIG. 22 is an outside view showing the other example of the process for joining the bundled portion of the fixing anchor.

Furthermore, as shown in FIG. 22, it is possible to hammer a concrete anchor plug 35 into the hole 28, filling the taper internal thread portion 36 formed in the anchor plug 35 with epoxy resin and the like, push and join the fixing anchors D1 to D14. In this case, contact effects can be exerted due to increase in the contact area by the internal thread portion 36. Thereby, the joining strength of the fixing anchors D1 to D14 can be improved.

Figure 23:
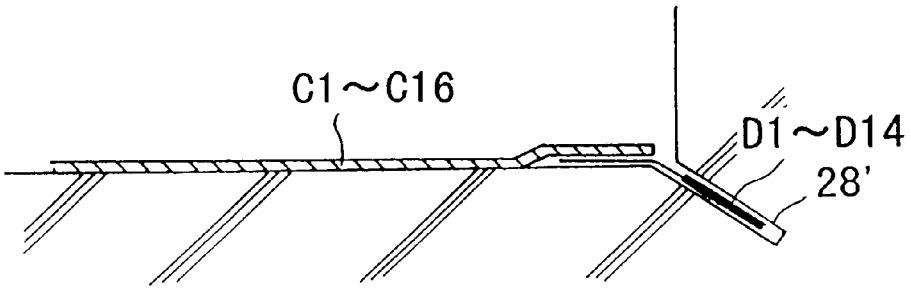
FIG. 23 is a plan sectional view and a longitudinal sectional view which show the other example of the joined structure in which the fixing anchor is joined to the column and the beam.

As shown in FIG. 23, the fixing anchors D1 to D14 may be joined in the hole 28' positioned at an angle to the joining surface of the reinforcing sheets C1 to C16, for example, approximately 5° to 45°. Thereby, the joining strength of the fixing anchors D1 to D14 can also be improved.

Figure 24:
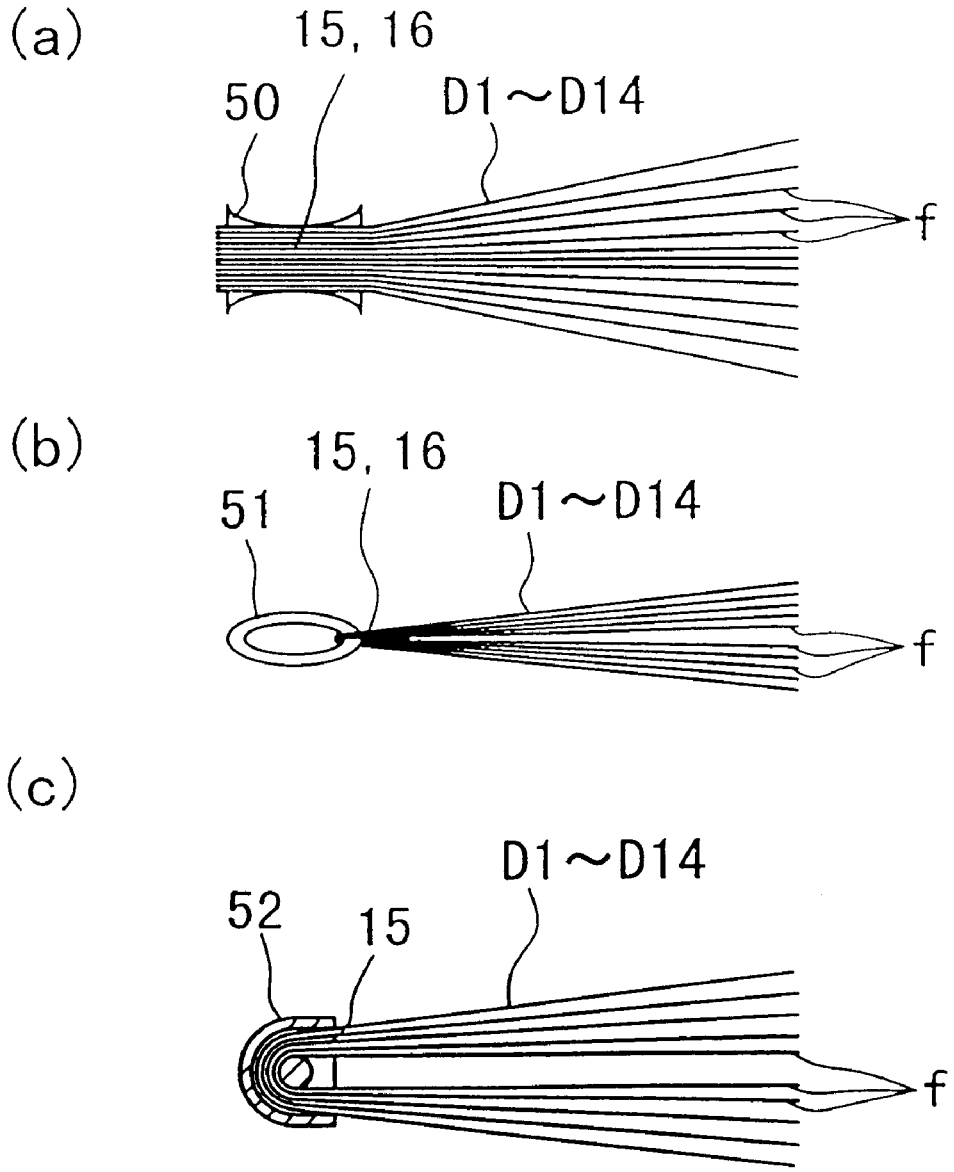
FIG. 24 is an outside view showing the other examples of the bundled portion of the fixing anchor.

As shown in FIG. 24, the bundled portion 15 of the fixing anchors D1 to D14 can be bundled by fasteners 50, 51, and 52 in the form of a tube, or a ring, in addition to above embodiments. When the fasteners 50, 51, and 52 are used, the joining strength of the fixing anchors D1 to D14 can be increased. In addition, the fasteners 50, 51, and 52 can be easily joined. Of course, the shape of the fasteners 50, 51, and 52 is not limited to the shape shown in FIG. 24.

In addition, it is also possible to impregnate bundles reinforcing fibers f in an adhesive or resin and bundle them at the construction site. Furthermore, it is possible to bundle in advance bundles of reinforcing fibers f only at the end using a resin and the like, and impregnate a required portion having a length into a resin and the like in construction site. Then, it is possible to change the length of the bundled portion 15 depending on the depth of the hole for joining the fixing anchors D1 to D14.

A part of bundles reinforcing fibers in the longitudinal direction may be bundled and joined by arranging the reinforcing fibers f in the hole leaving the reinforcing fibers unbundled, and filling the hole with a hardening filler.

Figure 25:
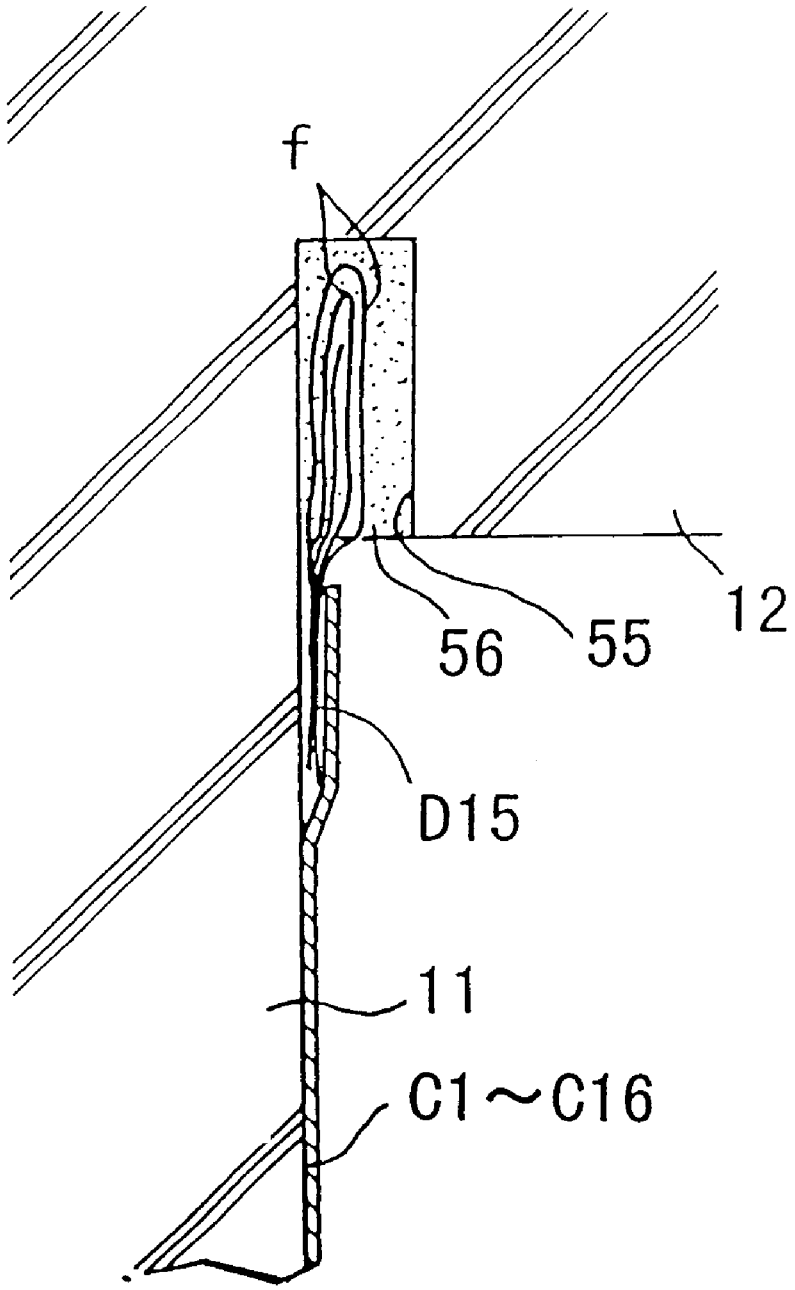
FIG. 25 is a view showing the other example of the fixing anchor, and is a longitudinal sectional view showing the fixing anchor comprising bundles of the reinforcing fibers which are not bundled inserted and joined into a hole.

As shown in FIG. 25, the fixing anchor D15 is joined by bending a large amount of reinforcing fibers f at the center portion in the longitudinal direction, inserting the center portion into the hole 55 formed in the under surface of the floor 12, for example, and filling the hole 55 with hardening fillers, such as an adhesive 56. Thereby, the fixing anchor D15 can be bundled in a part of the reinforcing fiber f in the longitudinal direction using an adhesive 56 and the like, while the fixing anchor D15 can be joined in the hole 55.

Figure 26:
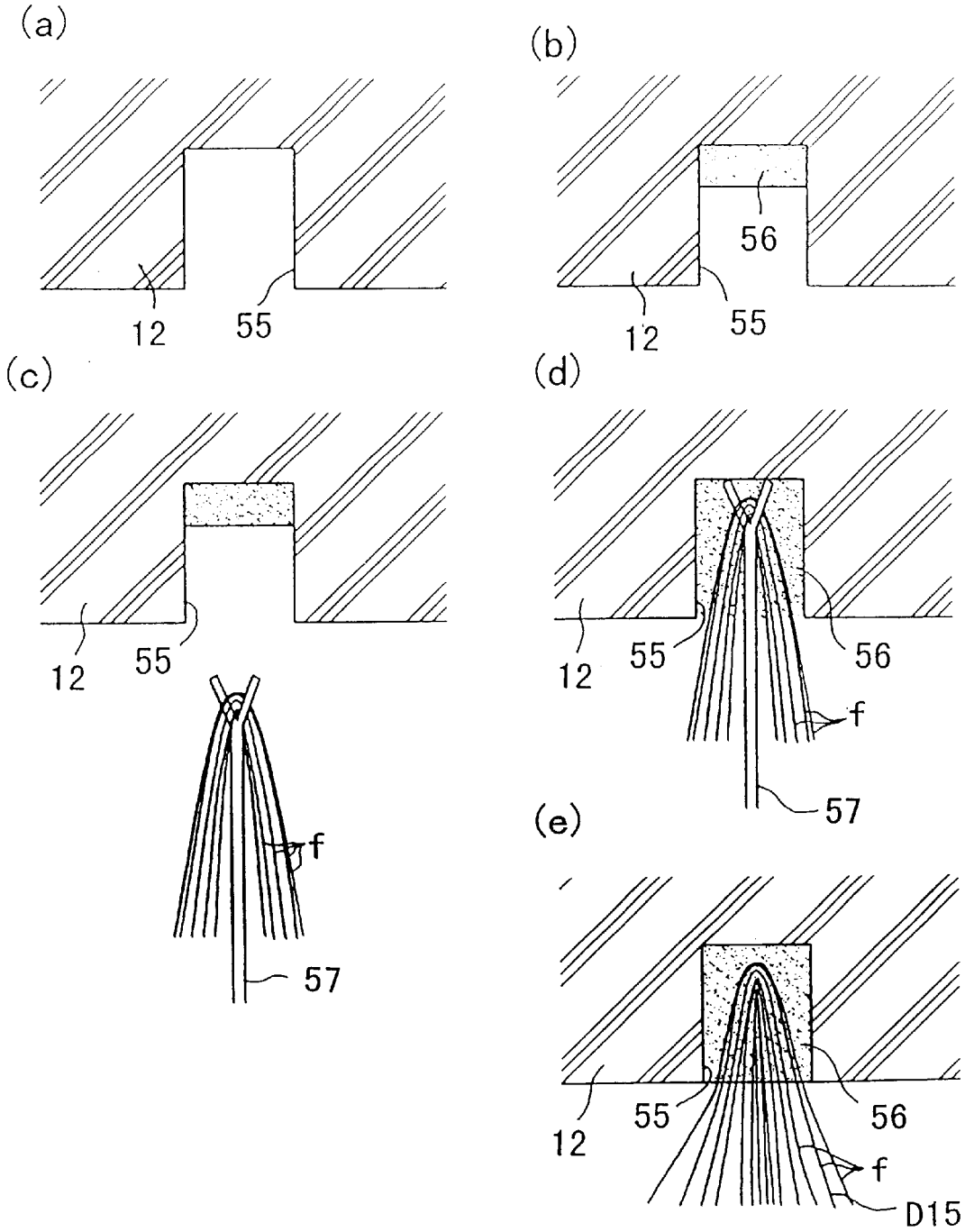
FIG. 26 is a view showing the processes for joining the fixing anchor as shown in FIG. 25.

In order to reinforce using the fixing anchor D15, as shown in FIG. 26(*a*), the hole 55 is formed at a required position on the under surface of the floor 12, for example. Then, as shown in FIG. 26(*b*), the adhesive 56 is poured in the hole 55. As shown in FIG. 26(*c*), a required number of reinforcing fibers f are carried while supporting at a center portion of the reinforcing fibers f in the longitudinal direction by the rod 57 having a V-shape end. As shown in FIG. 26(*d*), the rod 57 carrying the reinforcing fibers f is inserted into the hole 55, and then only the rod 57 is pulled down. As shown in FIG. 26(*e*), the center portion of the reinforcing fibers f in the longitudinal direction which is pushed into the hole 55, is joined into the hole 55 due to hardening of the adhesive 56 in the hole 55. Thereby, the fixing anchor D15 is joined into the hole 55. After that, as shown in FIG. 25, the construction is finished by spreading the fixing anchor D15 along the side surface of the beam 11, and attaching the reinforcing sheet C1 to C16 thereon.

When the fixing anchor D15 is used, as explained in the above examples, it is not necessary to make in advance the fixing anchor comprising a plurality of bundled reinforcing fibers; therefore, a lower cost can be achieved. In addition, the number or length of the reinforcing fibers can also be easily changed at the construction site; therefore, the reinforcing construction can be more easily performed. Of course, it is possible to adopt the fixing anchor D15 to any object, such as a column 10, beam 11, wall 13, and the like, in addition to the floor 12.

Moreover, the reinforcing sheets C1 to C16 and the fixing anchors D1 to 15 are attached by an adhesive, and the like in the first to ninth examples; however, any material can be used in so far as the required fixing strength can be exerted. Whether the material is organic or inorganic does not matter. In addition, another joint method can be adopted, in addition to an adhesion.

Regarding to the material comprising the reinforcing sheets C1 to C16 and the fixing anchors D1 to D15, other materials can be adopted, in addition to carbon fibers, aramid fibers, glass fibers, as explained above.

Regarding to the reinforcing sheets C1 to C16, in so far as the reinforcing effects can be exerted in the required direction, the fiber alignment direction (corresponding to the weaving direction when the reinforcing fibers are in the form of a cloth) thereof is not limited to the vertical direction, horizontal direction, and oblique direction. In addition, the superimposed number of the reinforcing sheets C1 to C16 is also not limited.

Steel plate, FRP (fiber reinforced plastics), and the like, can be used as the reinforcing sheets C1 to C16.

Figure 27:
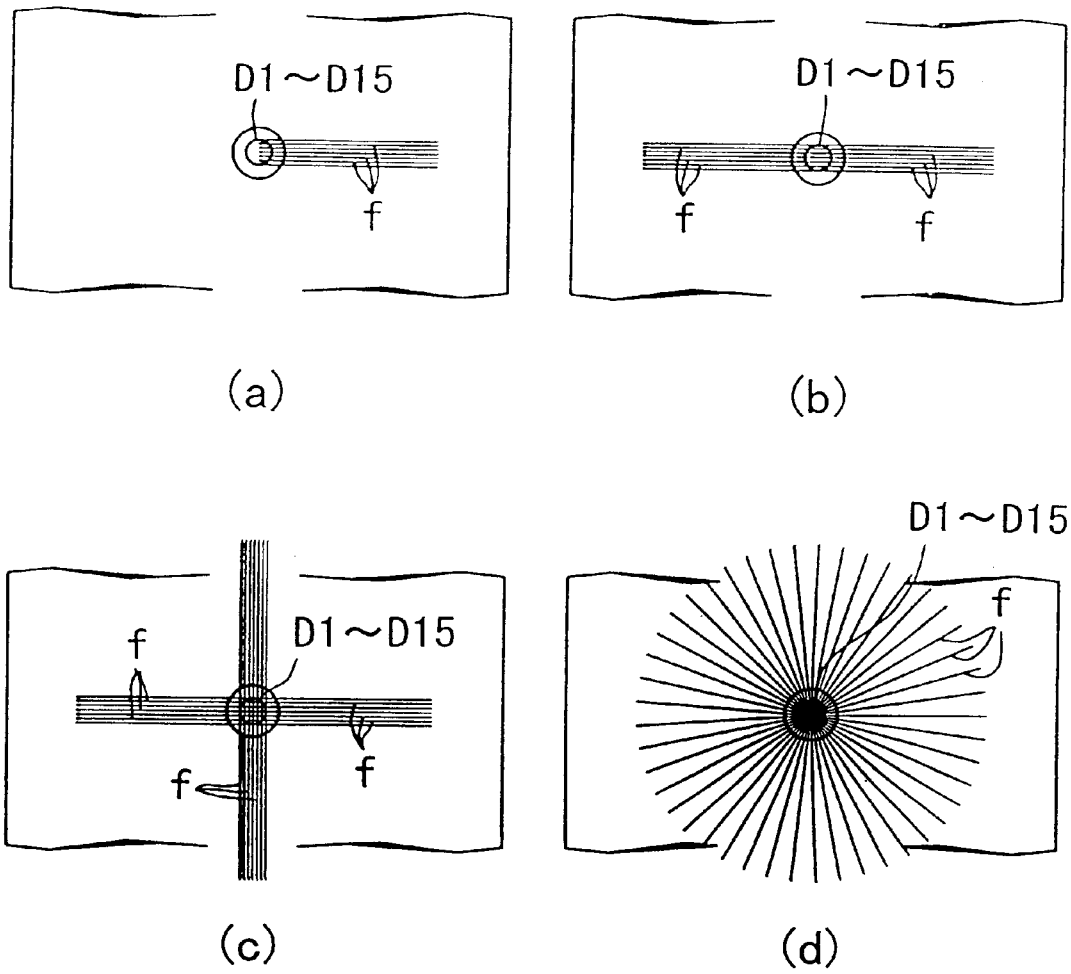
FIG. 27 is a view showing the application example of a spreading manner of the fixing anchor.

The method of spreading the reinforcing fibers f at the unbundled portion of the fixing anchors D1 to D15 is random. The reinforcing fibers f may be spread in any direction, such as one direction, two directions, four directions, or all directions. Any spreading method can be adopted. For example, the reinforcing fibers f can be spread so as to be shaped like a fan. Furthermore, when the bundled portions 15 and 16 of the fixing anchors D1 to D15 are joined perpendicularly to the surface of the concrete member, for example, the reinforcing fibers f at the unbundled portion can be spread as shown in FIGS. 27(*a*) to(*d*).

Figure 28:
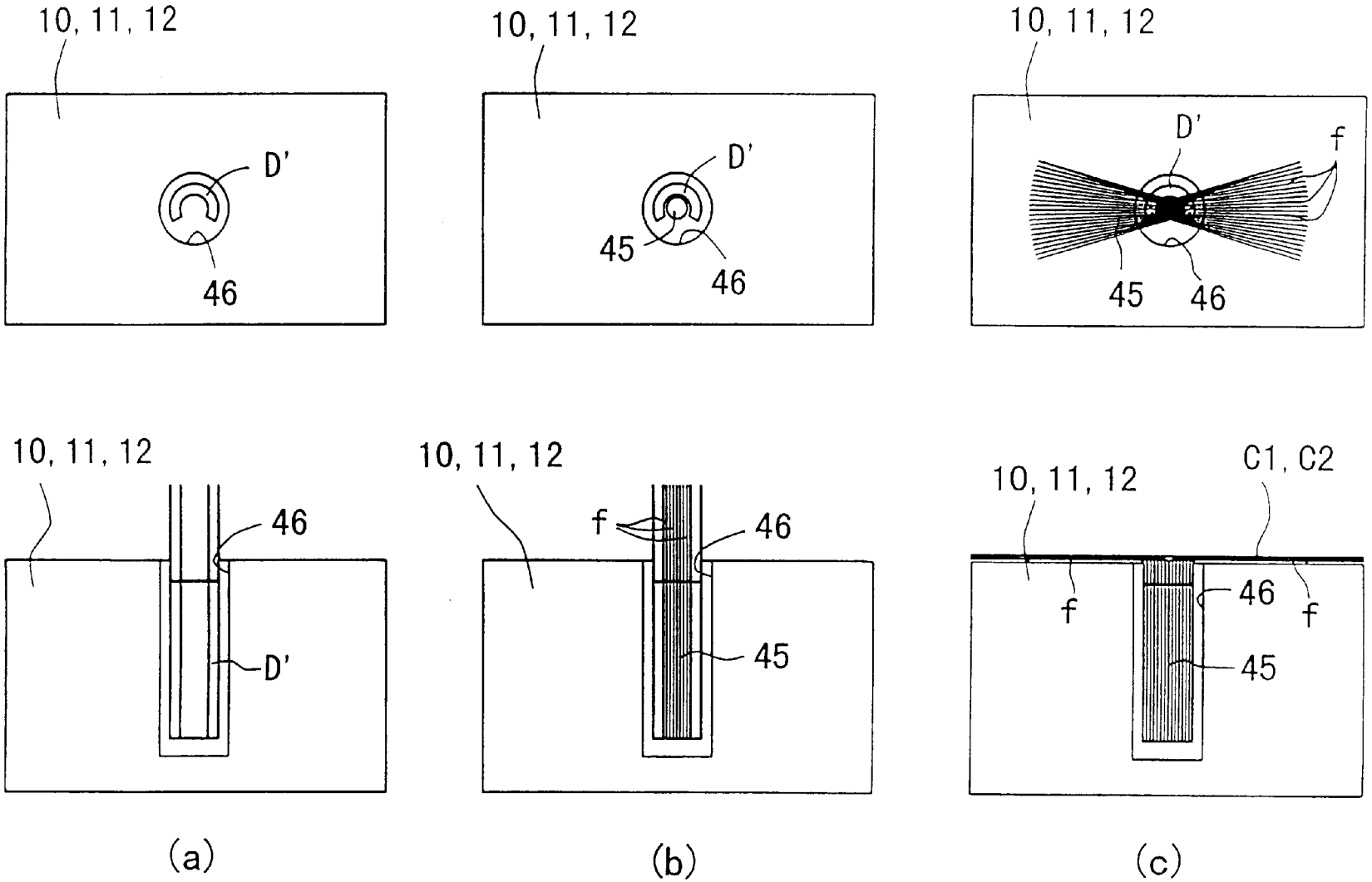
FIG. 28 is a view showing the other fixing anchor, and is a view showing the processes of joining the fixing anchor.

The fixing anchor D1 can be used together with the member shown in FIG. 20. Moreover, for example, as shown in FIG. 28, it is possible to combine the fixing anchor D' having a cross-sectional shape in the form of a substantial C shape and a bundle 45 (unbundled) comprising a large amount of reinforcing fibers f. In this case, as shown in FIG. 28(*a*), the fixing anchor D' is joined in the hole 46 formed in the column 10, beam 11, floor 12, and the like. Then, as shown in FIG. 28(*b*), a bundle 45 (unbundled) comprising a large amount of reinforcing fibers f is inserted into the fixing anchor D' having a cross-sectional shape in the form of a substantial C shape. The fixing anchor D' and the bundle 45 are joined in the hole 46 by filling the hole 46 with an adhesive and the like. After that, as shown in FIG. 28(*c*), the reinforcing fibers f of the fixing anchor D' and the bundle 45 are spread, the reinforcing sheet C1 to C16 is attached thereto.

Figure 29:
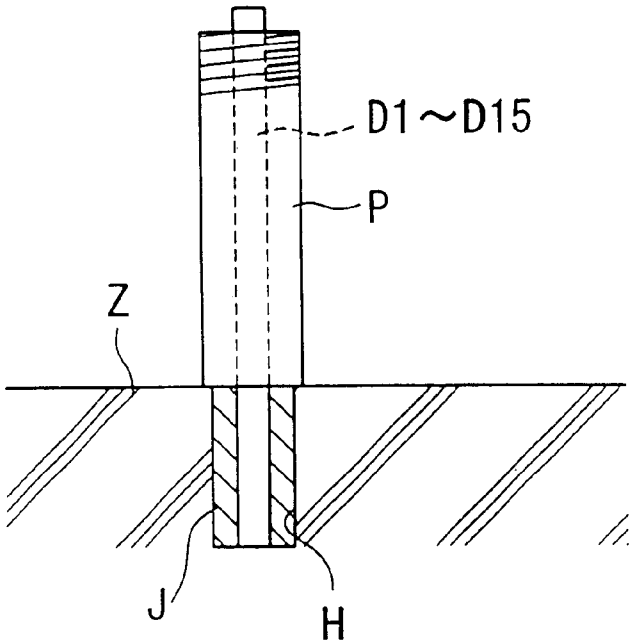
FIG. 29 is a view showing a pull-out test of the fixing anchor.
Figure 29:
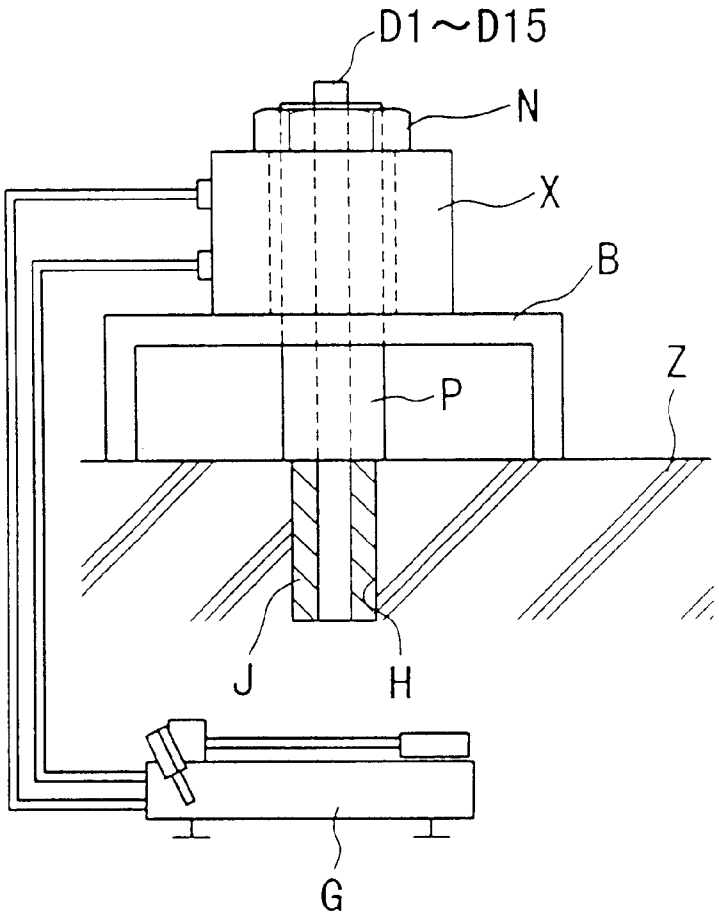
Figure 30:
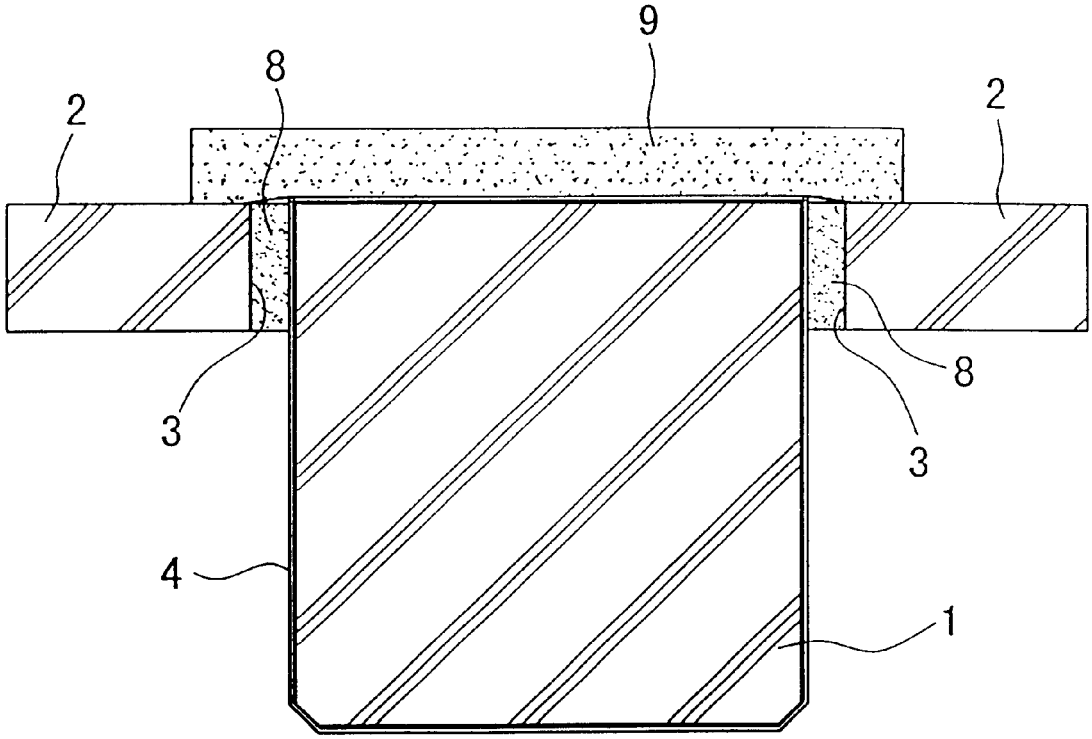
FIG. 30 is a sectional view showing a conventional structure for reinforcing a concrete member.

In order to perform a pull-out test of the fixing anchors D1 to D15 joined in the above manner, as shown in FIG. 29(*a*), the fixing anchor D1 to D15 is pushed into the hole H formed in the concrete Z, and the hole H is filled with the resin J and the like for joining the fixing anchor D1 to D15. As shown in FIG. 29(*b*), the pipe P is set on the surface of the concrete Z so that the fixing anchor D1 to D15 is inside of the pipe P, and an expansive cement is poured in the pipe P; thereby, the fixing anchor D1 to D15 and the pipe P are integrally joined. Then, a reaction stand B is set on the concrete Z, and a center hole type jack X is set on the reaction stand B. A nut N is driven in a screw portion formed at the end of the pipe P. Maintaining the conditions, the jack X is extended by a driving source G. Thereby, the pull-out test of the fixing anchor D1 to D15 is performed.

It is possible to perform the pull-out test of the fixing anchor D1 to D15 without damage of the fixing anchor D1 to D15.

Industrial Applicability

The structure for reinforcing a concrete member and the reinforcing method of the present invention can reinforce various kinds of a concrete member, such as column, beam, wall, floor, and the like against the bending stress and shearing stress applied thereto. The edges of the reinforcing member can be securely joined by joining the reinforcing member, via the fixing anchor. Therefore, it is possible to exert reliably the reinforcing effects to the concrete member. In addition, during the construction, the only source of the construction noise and vibration is the drilling the holes and/or recesses, you can minimize the noise and the vibration. Therefore, the construction can be easily performed. Moreover, it is possible to adopt easily the structure for reinforcing a concrete member and the reinforcing method of the present invention to existing buildings.

What is claimed is:

1. A reinforced concrete structure comprising:

a concrete member;

a fixing anchor which comprises a bundle of reinforcing fiber, said bundle of reinforcing fiber having a bundled part and at least one unbundled part; and a reinforcing member in the form of one of a plate and a sheet;

wherein the bundled part of said fixing anchor is embedded into the concrete member and the, at least one unbundled part is spread and adhered on to the concrete member using resin adhesives;

the reinforcing member is applied to the concrete member so as to overlap at least edges of the reinforcing member onto the unbundled part of the fixing anchor; and the unbundled part of the fixing anchor is sandwiched between the concrete member and the reinforcing member.

2. A reinforced concrete structure according to claim 1, wherein said reinforcing member is in the form of a sheet and comprises reinforcing fibers selected from a group consisting of carbon fibers, aramid fibers, and glass fibers.

3. A reinforced concrete structure according to claim 1, wherein said fixing anchor is arranged inside of a recess formed in the concrete member and the recess is filled with a hardening filler.

4. A reinforced concrete structure according to claim 1, wherein a fixing reinforcing member is applied onto the over-lapped part of the reinforcing member and the fixing anchor, perpendicularly to a longitudinal direction of the reinforcing member.

5. A reinforced concrete structure according to claim 1, wherein said reinforcing member is applied and joined along a longitudinal direction of the concrete member.

6. A reinforced concrete structure according to claim 1, wherein said reinforcing member is applied and joined along a circumferential direction of the concrete member.

7. A reinforced concrete structure according to claim 1, wherein said reinforcing member is applied to and joined along the concrete member in the form of one of a plane and curved surface.

8. A reinforced concrete structure according to claims 1, wherein said reinforcing member comprises reinforcing fibers aligned in a first direction, and is joined to the surface of the concrete member so that the reinforcing fibers are aligned at an angle to a longitudinal axis of the concrete member.

9. A reinforced concrete structure according to claim 1, wherein said reinforcing fiber comprising said fixing anchor is selected from the group consisting of carbon fiber, aramid fiber, and glass fiber.

10. A structure as in claim 1, wherein said unbundled part of said fixing anchor comprises an unbundled end of said fixing anchor.

11. A structure as in claim 1, wherein said bundled part is defined at a longitudinal end of said fixing anchor.

12. A reinforced concrete structure comprising:

a first concrete member;

a second concrete member disposed to surround at least a part of said first concrete member;

a fixing anchor which comprises a bundle of reinforcing fiber, said bundle of reinforcing fiber having a bundled part and an unbundled part; and a reinforcing member in the form of one of a plate and a sheet;

wherein said bundled part of said fixing anchor is embedded into the second concrete member and said unbundled part is spread and adhered on to the first concrete member using resin adhesives;

the reinforcing member is applied to the first concrete member so as to overlap at least edges of the reinforcing member onto the unbundled part of the fixing anchor; and the unbundled part of the fixing anchor is sandwiched between the first concrete member and the reinforcing member.

13. A reinforced concrete structure according to claim 12, wherein said reinforcing member is in the form of a sheet and comprises reinforcing fibers selected from a group consisting of carbon fibers, aramid fibers, and glass fibers.

14. A reinforced concrete structure according to claim 12, wherein said fixing anchor is arranged inside of a hole formed in the second concrete member and the hole is filled with a hardening filler.

15. A reinforced concrete structure according to claim 12, wherein a fixing reinforcing member is applied onto the over-lapped part of the reinforcing member and the fixing anchor, perpendicularly to a longitudinal direction of the reinforcing member.

16. A reinforced concrete structure according to claim 12, wherein said reinforcing member is applied and joined along a longitudinal direction of the first concrete member.

17. A reinforced concrete structure according to claim 12, wherein said reinforcing member is applied and joined along a circumferential direction of the first concrete member.

18. A reinforced concrete structure according to claim 12, wherein said reinforcing member is applied to and joined along the first concrete member in the form of one of a plane and a curved surface.

19. A reinforced concrete structure according to claim 12, wherein said reinforcing member comprises reinforcing fibers aligned in a first direction, and is joined to the surface of the first concrete member so that the reinforcing fibers are aligned at an angle to the longitudinal axis of the first concrete member.

20. A reinforced concrete structure according to claim 12, wherein said reinforcing fiber comprising said fixing anchor is selected from the group consisting of carbon fiber, aramid fiber, and glass fiber.

21. A method of reinforcing a concrete member comprising the steps of:

joining a fixing anchor comprising a bundle of reinforcing fiber in a recess formed in a concrete member;

applying a reinforcing member in the form of one of a plate and a sheet on a surface of the concrete member; and superposing and adhering the edges of the reinforcing member to an end portion of the fixing anchor with adhesives so as to sandwich at least the end portion of the fixing anchor between the concrete member and the reinforcing member.

22. A reinforcing method according to claim 21, wherein a part of the fixing anchor is embedded in a recess by forming the recess at the surface of the concrete member to be reinforced, inserting the part of the fixing anchor in the recess, and filling the recess with a hardening filler.

23. A reinforcing method according to claim 21, wherein a part of said bundle of reinforcing fiber is bundled by inserting a part of the reinforcing fibers into the recess, and filling the recess with a hardening filler.

24. A reinforcing method according to claim 21, wherein the reinforcing fiber comprising said fixing anchor is selected from the group consisting of carbon fiber, aramid fiber, and glass fiber.

25. A method of reinforcing a first concrete member surrounded at least in part by a second concrete member, comprising the steps of:

joining a fixing anchor comprising a bundle of reinforcing fiber in a hole formed in the second concrete member;

applying a reinforcing member in the form of one of a plate and a sheet on a surface of the first concrete member; and superposing and adhering the edges of the reinforcing member to an end portion of the fixing anchor with adhesives so as to sandwich at least the end portion of the fixing anchor between the first concrete member and the reinforcing member.

26. A reinforcing method according to claim 25, wherein a part of the fixing anchor is embedded in a hole by forming the hole at the surface of the second concrete member, inserting the part of the fixing anchor in the hole, and filling the hole with a hardening filler.

27. A reinforcing method according to claim 25, wherein a part of the bundle of reinforcing fiber is bundled by inserting a part of the reinforcing fibers into the recess, and filling the recess with a hardening filler.

28. A reinforcing method according to claim 25, wherein the reinforcing fiber comprising said fixing anchor is selected from the group consisting of carbon fiber, aramid fiber, and glass fiber.

29. A structure for reinforcing a concrete member comprising:

a fixing anchor which comprises a bundle of reinforcing fiber, said bundle of reinforcing fiber having a bundled part and an unbundled part;

and a reinforcing member in the form of one of a plate and a sheet;

wherein said unbundled part of said fixing anchor is spread and adhered at an edge of the reinforcing member, at least one end of the bundled part of said fixing anchor, near the unbundled part, is arranged substantially parallel to said surface of the reinforcing member; and a direction of the reinforcing fibers of the bundled part of said fixing anchor is substantially perpendicular to the respective edge of the reinforcing member.

30. A structure as in claim 27, comprising a plurality of said fixing anchors, an unbundled part of each said fixing anchor being spread and adhered to the edge of the reinforcing member.

31. A structure as in claim 29, wherein said unbundled part of said fixing anchor,comprises an unbundled end of said fixing anchor.

32. A structure as in claim 29, wherein said bundled part is defined at a longitudinal end of said fixing anchor.

* * * * *

UNITED STATES PATENT AND TRADEMARK OFFICE

CERTIFICATE OF CORRECTION

PATENT NO. : 6,330,776 B1 
DATED : December 18, 2001
INVENTOR(S) : Jinno et al.

It is certified that error appears in the above-identified patent and that said Letters Patent is hereby corrected as shown below:

Title page,
The following should be inserted:

-- Related U.S. Application Data

[63] Continuation of Application No. PCT/JP98/04149, filed on September 16, 1998. --

Signed and Sealed this

Third Day of September, 2002

*Attest:*

*Attesting Officer*

JAMES E. ROGAN
*Director of the United States Patent and Trademark Office*